US010614652B2

(12) United States Patent
Thompson et al.

(10) Patent No.: US 10,614,652 B2
(45) Date of Patent: Apr. 7, 2020

(54) ELECTRONIC GAMING SYSTEM WITH FLUSH MOUNTED DISPLAY SCREEN

(71) Applicant: AGS, LLC, Las Vegas, NV (US)

(72) Inventors: Mark Andrew Thompson, Buford, GA (US); Prashant L. Shah, Elk Grove Village, IL (US); Sigmund Hyunjai Lee, Atlanta, GA (US)

(73) Assignee: AGS LLC, Las Vegas, NV (US)

( * ) Notice: Subject to any disclaimer, the term of this patent is extended or adjusted under 35 U.S.C. 154(b) by 603 days.

(21) Appl. No.: 15/040,038

(22) Filed: Feb. 10, 2016

(65) Prior Publication Data

US 2016/0163148 A1 Jun. 9, 2016

Related U.S. Application Data

(62) Division of application No. 13/887,869, filed on May 6, 2013, now abandoned.

(51) Int. Cl.
*G07F 17/32* (2006.01)

(52) U.S. Cl.
CPC ..... *G07F 17/3211* (2013.01); *G07F 17/3209* (2013.01)

(58) Field of Classification Search
CPC ..... G07F 17/32; G07F 17/3211
USPC ..... 463/31
See application file for complete search history.

(56) References Cited

U.S. PATENT DOCUMENTS 4,412,255 A * 10/1983 Kuhlman ..... H05K 9/00 348/819
4,440,457 A 4/1984 Fogelman et al.
4,856,088 A 8/1989 Oliwa et al.
4,948,138 A 8/1990 Pease et al.
D333,164 S 2/1993 Kraft et al.
5,537,149 A 7/1996 Teraoka et al.
5,557,064 A * 9/1996 Isern-Flecha ..... H05K 3/284 174/378
5,575,544 A 11/1996 Hasegawa et al.
5,696,529 A 12/1997 Evanicky
(Continued)

FOREIGN PATENT DOCUMENTS

GB 2300062 A * 10/1996 ..... G07F 17/32

OTHER PUBLICATIONS

Sony; Sony XAV601BT Manual—Detaching and attaching the front panel; esupport.sony.com; https://esupport.sony.com/US/p/model-home.pl?mdl=XAV601BT&template_id=1&region_id=1&tab=manuals#/manualsTab; 2 pages; downloaded Dec. 20, 2016.
(Continued)

*Primary Examiner* — Omkar A Deodhar
*Assistant Examiner* — Shauna-Kay Hall
(74) *Attorney, Agent, or Firm* — Weide & Miller, Ltd.

(57) ABSTRACT

An electronic gaming machine includes a housing and a display frame which is connected to the housing, the display frame having a display opening. An electronic video display is mounted to the housing and is located in the display opening of the display frame, the electronic video display having a front screen having a peripheral edge which extends around a display area, a peripheral border extending over the front screen between the peripheral edge thereof and the display area, and an insulating strip positioned between the electronic video display and the display frame at the peripheral edge of the front screen.

24 Claims, 18 Drawing Sheets

(56) References Cited

U.S. PATENT DOCUMENTS 5,813,914 A 9/1998 McKay et al.
5,951,128 A 9/1999 Aidone et al.
6,002,582 A * 12/1999 Yeager ..... G02F 1/133308 248/917
D424,122 S 5/2000 Dickenson et al.
6,135,884 A * 10/2000 Hedrick ..... G07F 17/3211 273/143 R
6,315,666 B1 * 11/2001 Mastera ..... G07F 17/32 463/20
6,334,612 B1 1/2002 Wurz et al.
D459,402 S 6/2002 Wurz et al.
D460,915 S 7/2002 Lynch
6,443,837 B1 9/2002 Jaffe et al.
D464,377 S 10/2002 Wurz et al.
6,475,087 B1 11/2002 Cole
6,545,863 B2 4/2003 Huggins
6,578,847 B1 6/2003 Hedrick et al.
6,702,409 B2 3/2004 Hedrick et al.
D495,755 S 9/2004 Wurz et al.
D496,407 S 9/2004 Gadda et al.
6,820,875 B1 * 11/2004 Hedrick ..... A63F 13/08 273/138.1
6,860,814 B2 3/2005 Cole
6,935,946 B2 8/2005 Yoseloff et al.
6,976,915 B2 * 12/2005 Baker ..... G07F 17/32 40/564
6,997,810 B2 2/2006 Cole
7,130,190 B1 10/2006 Baker
D559,917 S 1/2008 Cole
D626,182 S 10/2010 Cole et al.
7,862,436 B2 1/2011 Cole
7,904,236 B2 * 3/2011 Ueno ..... G01C 21/3688 307/10.1
8,016,682 B2 9/2011 Stephenson, III et al.
8,016,683 B2 9/2011 Cole
8,082,559 B2 12/2011 Yamada et al.
2002/0022509 A1 2/2002 Nicastro
2002/0030966 A1 3/2002 Huggins
2002/0183105 A1 12/2002 Cannon et al.
2004/0018870 A1 * 1/2004 Cole ..... A63F 13/08 463/20
2004/0166937 A1 * 8/2004 Rothschild ..... G07F 17/32 463/36
2004/0207156 A1 10/2004 Soltys et al.
2004/0239619 A1 * 12/2004 Takahashi ..... G06F 1/1601 345/156
2005/0124417 A1 * 6/2005 Sosnoski ..... G07F 17/32 463/46
2005/0215325 A1 9/2005 Nguyen et al.
2005/0288090 A1 12/2005 Thomas et al.
2005/0288097 A1 * 12/2005 Rasmussen ..... G07F 17/3211 463/30
2006/0073900 A1 4/2006 Cole
2006/0131810 A1 6/2006 Nicely
2007/0225079 A1 9/2007 Cole
2007/0238531 A1 * 10/2007 Taxon ..... G07F 17/32 463/46
2007/0295020 A1 12/2007 Lee
2008/0113819 A1 * 5/2008 Tedsen ..... G07F 17/3211 463/46
2008/0202879 A1 * 8/2008 Parks ..... F16H 41/24 192/3.21
2009/0221375 A1 * 9/2009 Luciano, Jr. ..... G07F 17/32 463/46
2010/0173704 A1 7/2010 Cole
2010/0188808 A1 7/2010 Howarth et al.
2011/0058326 A1 3/2011 Idems
2011/0092283 A1 * 4/2011 Levitan ..... A63F 13/08 463/31
2011/0151958 A1 6/2011 Cole
2012/0062211 A1 3/2012 Neal et al.
2012/0302358 A1 11/2012 Cole
2012/0322564 A1 12/2012 Granger
2013/0023346 A1 1/2013 Greenberg
2013/0079157 A1 3/2013 Chudek
2014/0179422 A1 6/2014 Thompson et al.

OTHER PUBLICATIONS

Sony XAV601BT. Amazon.com. Online. Accessed via the Internet. Accessed Nov. 13, 2013. <URL: http://www.amazon.com/Sony-XAV601BT-Bluetooth-MirrorLink-Technology/dp/B0086V637Y#produceDetails>; 8 pages.
Dirak Inc.; 1-046SL Fastener SNAP-LINE 30X10; http://www.bdproduct.ca/wp-content/uploads/2013/06/Dirak-Fasteners-22.pdf; Copyright Oct. 1, 2012; 1 Page.
Sony; Sony XAV601BT Operating Instructions; esupport.sony.com; https://esupport.sony.com/US/p/model-home.pl?mdl=XAV601BT&template_id=1&region_id=1&tab=manuals#/manualsTab; 72 pages; Copyright 2012.

* cited by examiner

ELECTRONIC GAMING SYSTEM WITH FLUSH MOUNTED DISPLAY SCREEN

RELATED APPLICATION DATA

This application is a divisional of U.S. application Ser. No. 13/887,869, filed May 6, 2013.

FIELD OF THE INVENTION

The present invention relates to an electronic gaming system and method of configuring an electronic gaming system. More specifically, the disclosure relates to an electronic gaming system which has one or more flush mounted display screens, and associated methods.

BACKGROUND OF THE INVENTION

The gaming industry has numerous casinos located both worldwide and in the United States. A client of a casino or other gaming entity can gamble via various games of chance. For example, craps, roulette, baccarat, blackjack, and electronic or electromechanical games (e.g., a slot machine, a video poker machine, and the like) where a person may gamble on an outcome.

Historically, the success of electronic gaming systems is dependent on several elements, which may not be readily apparent. Success can depend upon the prospect of winning money from the gaming system, whether such prospect is real or perceived which can carry an intrinsic entertainment value as compared to other gaming system offerings. Additionally, the success can also depend upon the ease by which a new player can understand, and/or interface with, the game mechanics and/or gaming system, as it is unlikely that a new player will expend money wagering on a gaming system if they do not understand the game mechanics or do not understand how to interface with the gaming system. A player's enjoyment and interest in a game may be increased by employing an electronic gaming system and methods that provide one or more flush display screens which can make it easier for the player to interface with a gaming system and/or gaming mechanics.

SUMMARY OF THE INVENTION

Embodiments of the invention comprise methods of mounting displays such as electronic video displays, display mounting configurations, and gaming devices having one or more displays. In one embodiment, a flush-mount display configuration is disclosed.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
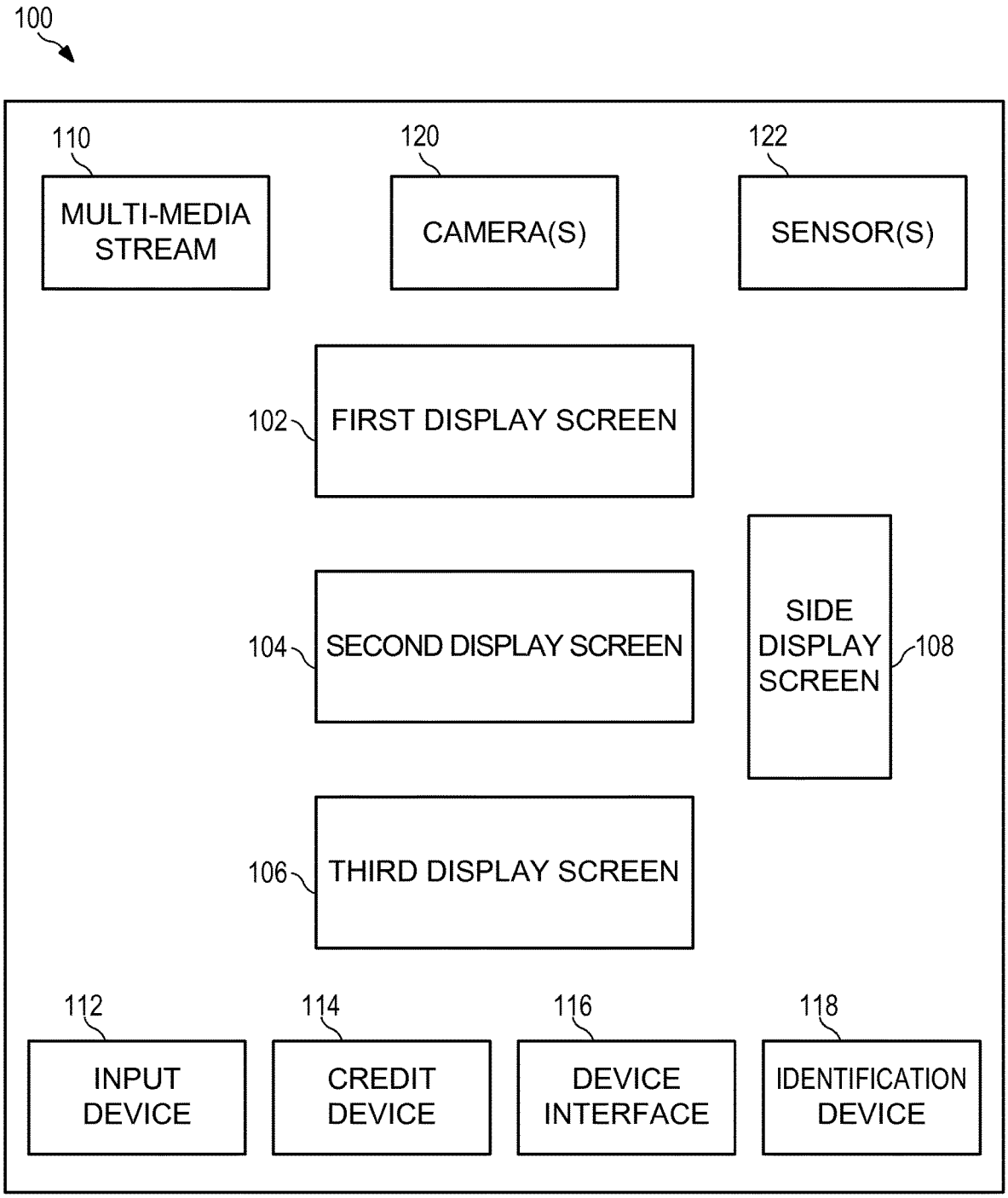
FIG. 1 is an illustration of the electronic gaming device, according to one embodiment.

One embodiment of the invention is FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to move one or more flush displays (and/or a portion thereof), to select one or more reel gaming functionality, to control any object (e.g., a tool, a person, an image, a selection option, etc.), to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more reel gaming functionality may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, a player may want to have game play which has only a specific type of reel gaming functionality (e.g., 3D gaming options). Therefore, no games without 30 reel gaming functionality would be presented. In another example, the player may only want to play games that include pattern gaming options only. Therefore, only games which include pattern gaming options would be presented to the player. In another example, the player may only want to play games that include historical information relating to game play. Therefore, only games which include historical gaming data would be presented to the player. The player may want game play with a specific variance (e.g., low payout variance, average payout variance, high payout variance, etc.). Therefore, only games with the specific payout variance would be displayed. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

The presentations associated with one or more gaming options may be presented on one, a few, and/or a plurality of screens. These presentations associated with one or more reel gaming functionalities may be displayed on a portion of one, a few, and/or a plurality of these screens.

For example, a single large image could be partially displayed on second display screen 104 and partially displayed on third display screen 106, so that when both display screens are put together they complete one image. Electronic gaming device 100 may stream or play prerecorded multimedia data, which may be displayed on any display combination.

Figure 2:
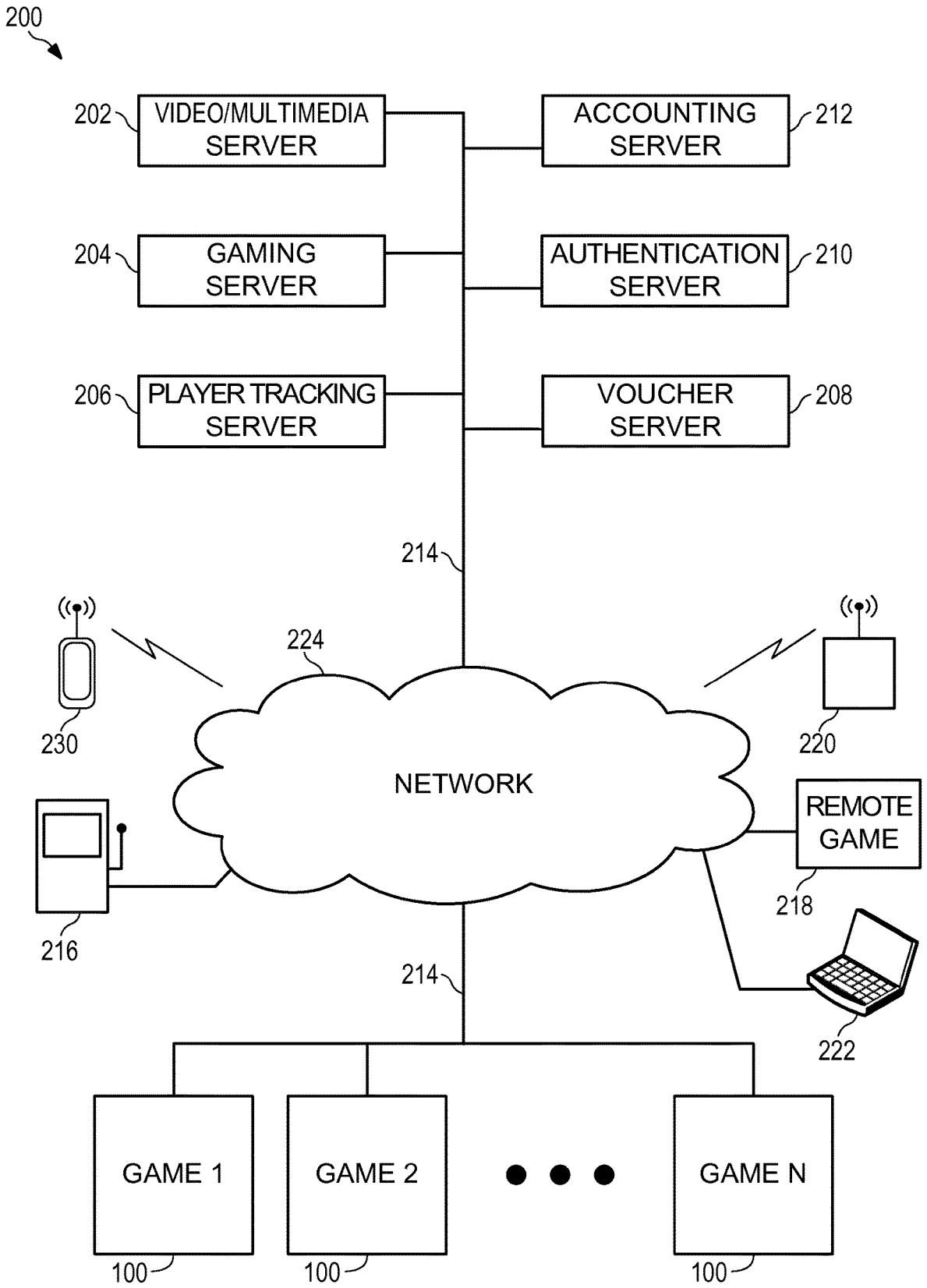
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of a payout functionality, a reel gaming functionality, a reel gaming evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include reel gaming play data, repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Statistics server may include data relating to one or more reel based game plays. This data may include the number of times a specific item (e.g., a first part of reel one, reel one, a first part of reel two, a second part of reel two, a rose, a star, etc.) was selected and/or replaced. The frequency of any specific item being selected and the amount won. This data may also include data relating to any interrelationship of elements. For example, when a first part of reel one is replaced with a first replacement symbol, then 30% of the time a second part of reel one is replaced with the first replacement symbol, and then 15% of the time a third part of reel one is replaced with the first replacement symbol. In another example, when a first part of reel one is replaced with a first replacement symbol, then 45% of the time a second part of reel two is replaced with the second replacement symbol, and then 10% of the time a third part of reel three is replaced with the third replacement symbol. In another example, when the star is selected, the player selects a rose on 75% of the time. Further, this selection pairing results in a winning result 55% of the time. This data may include the number of times a specific item (e.g., a tool, a movement pattern (e.g., jump up and to the right, etc.) was selected. The frequency of any specific item being selected and the amount won. This data may also include data relating to any interrelationship of elements. For example, when the rope is utilized, the player selects an upper right symbol to utilize the rope on 75% of the time. Further, this selection pairing results in a winning result 55% of the time. In another example, when the latter is selected as the tool to be utilized by the player, the player uses the latter to go up (instead of down or across) 63% of the time. Further, this selection pairing results in a winning result 79% of the time.

Figure 3:
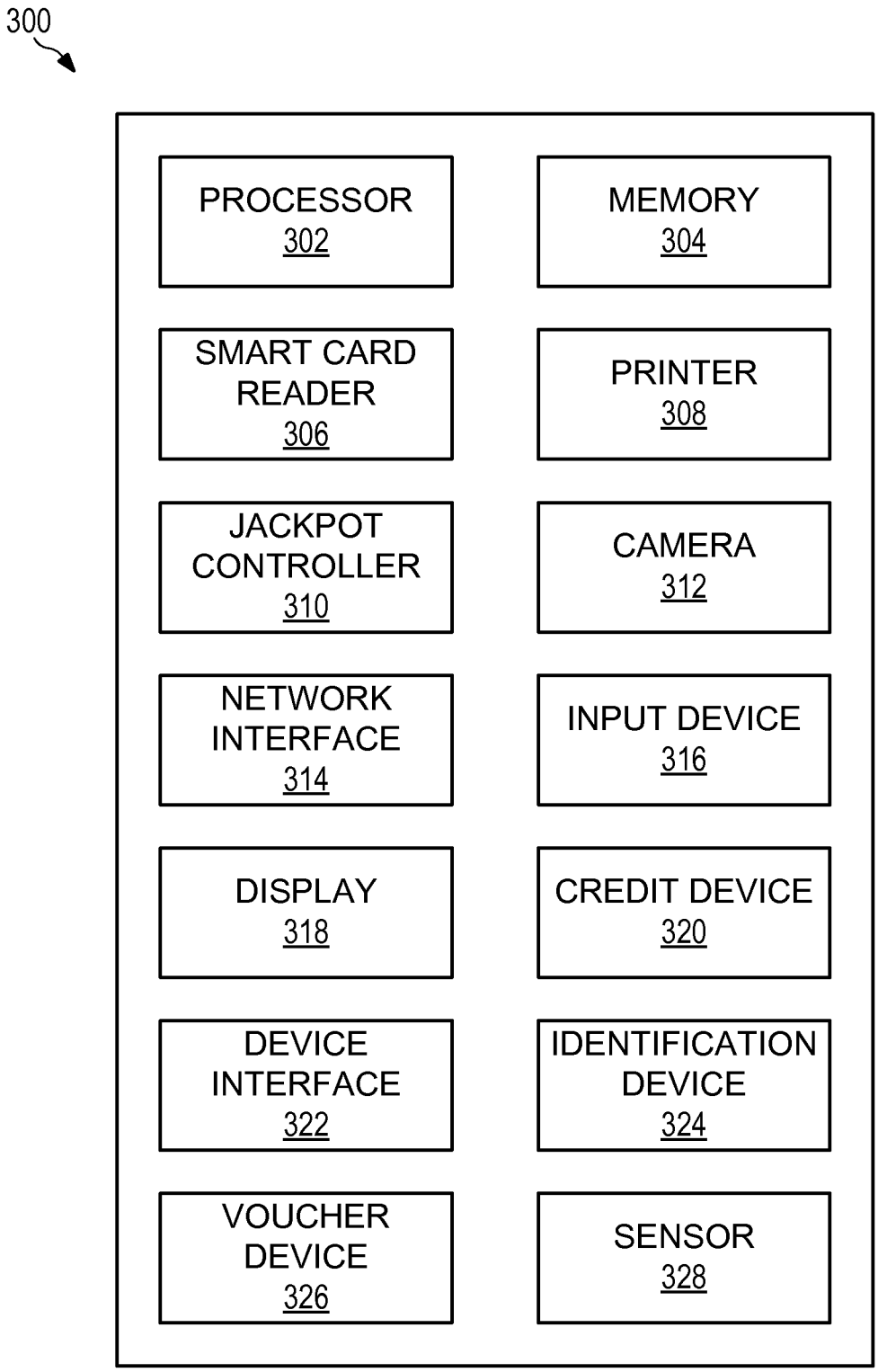
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, a voucher device 326, and one or more sensors 328.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more reel gaming functionality, to select one or more game elements, to select one or more theme-based gaming options, to make an offer to buy or sell a voucher, to determine a voucher's worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the positions of one or more flush screens (or parts thereof) may be moved, the characteristics (e.g., brightness, contrast, etc.) of one or more flush screens may be modified, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

One or more sensors 328 may include at least two different devices. For example, and discussed in more detail below, one of the at least two different devices may be an active device and/or one of the at least two different devices may be a passive device. In one example, such an active device may generate a wave of measurable energy (e.g., light, radio, etc.). In another example, such a passive device may be able to detect reflected waves generated by such an active device. In another example, such an active device and such a passive device may each communicate data related to their respective activity to a processor, and such processor may translate such data in order to determine the depth and/or image of a scene occurring near electronic gaming device 100.

In one example, a player may be seated on a seat in front of an exemplary gaming system. Gaming system may have a gaming cabinet side, which may be immediately adjacent to gaming cabinet front. The gaming system may be positioned on a base (e.g., pedestal) in order to provide, in association with seat, a more comfortable environment for the interaction and/or playing of the gaming system. In another example, one or more depth image sensing devices 328 may be located on the gaming cabinet front. In one embodiment, one or more depth image sensing devices 328 may have a first field edge and a second field edge, which together may help define a field angle. For example, the first field edge, the second field edge, and the angle may be 20 representations of a sample segment of a 30 cone-shaped field. In another example, the first field edge, the second field edge, and the field angle may be 2D representations of a sample segment of multiple, partially overlapping 3D cone-shaped fields. It should be appreciated that representations of field angles and field boundaries contained herein may simply be exemplary in nature, and may not intend to limit the extent of any particular field angle and/or field boundary.

In one embodiment, the first field edge, the second field edge, and the field angle may define the limits of a scene, which is capable of being sensed by one or more depth image sensing devices 328. For example, if a portion of a scene occurs outside of both the first field edge and the second field edge, then one or more depth image sensing devices 328 may not recognize such an occurrence, and therefore may not detect any change thereof. In another embodiment, the first field edge, the second field edge, and the field angle may define relative limits of a scene, which is capable of being sensed by one or more depth image sensing devices 328 to a relative degree of certainty. For example, if a portion of a scene repeatedly occurs just above the first field edge, then one or more depth image sensing devices 328 may only recognize such occurrence a percentage of the time (e.g., 10%).

In another example, the first field edge, the second field edge, the field angle, and/or any combination thereof may move and/or shift to obtain one or more scenes. For example, the first field edge and the second field edge may move while keeping the field angle constant. This movement may be based on the movement of one or more objects. In one example, a person moving from scene one to scene two may trigger the movement and/or shifting of the first field edge, the second field edge, the field angle, and/or any combination thereof.

In one embodiment, the player may not be made aware of the first field edge and/or the second field edge. In another embodiment, the player may be made aware of the first field edge and/or the second field edge. This may occur via a display screen, which indicates the viewable area (e.g., sensed area). In one example, one or more depth image sensing devices 328 may include, and/or electronic gaming device 100 may separately include, a visible light generator which may cause a light that is generally visible to the human eye to be generated along the first field edge and/or the second field edge. In one example, such a visible light may be a visible laser. In another example, such a visible light might be a colored light.

In another example, one or more depth image sensing devices 328 includes, and/or electronic gaming device 100 separately includes, a visible light generator which may cause a light that is generally visible to the human eye to be generated along a different field edge from both the first field edge and/or the second field edge. For example, one or more depth image sensing devices 328 may include a visible light generator which generates a visible light having two field edges which are in between the first field edge and/or the second field edge, such that the visible light's field angle is smaller than the field angle. In such an example, such a smaller visible light field angle may be beneficial in informing the player of a more optimal field for which scene changes may be detected.

In another example, one or more depth image sensing devices 328 may include a first source. First source may have a source angle. One or more depth image sensing devices 328 may also include a first sensor, which may have an associated sensor angle. Source angle and sensor angle may together define a first field edge and a second field edge. Together, the first field edge and the second field edge may define a field for which a body may be detected. In another example, the first source may be a light source. In one example, the first source may be a light source that produces a light that is typically not visible to the human eye. In another example, the first source may be an infrared ("IR") light source. In another example, the first sensor may be an active-pixel sensor ("APS"). In another embodiment, the first sensor may be a complementary metal-oxide-semiconductor sensor ("CMOS sensor"). In another embodiment, the first sensor may be a charge-coupled device ("CCD") image sensor. In another embodiment, the first sensor may be an APS imager or an active-pixel image sensor.

In one embodiment, the first source may be a sound source. In one example, the first source may be a sound source that produces a sound that is typically not perceptible to the human ear. In another example, the first source may produce an ultrasonic sound wave. In another example, the first sensor may be a piezoelectric transceiver. In another embodiment, the first sensor may include one or more piezoelectric crystals. In another embodiment, the first sensor may include one or more microphones.

In one embodiment, operation of one or more depth image sensing devices 328 may include the first source generating waves of energy within the source angle, and the first sensor may detect the return, bouncing, and/or distortion of such generated waves within the first sensor angle. For example, the first source may generate an IR light, which may illuminate and reflect or otherwise bounce off of physical objects located within the first field, and the first sensor may be a CMOS sensor, which may detect such reflected IR light. In this manner, it is possible to analyze the resulting data, which may include data about the IR light transmission and the resulting detection of the reflected IR light, to determine the composition of a scene occurring within the first field.

In one embodiment, the composition of a scene and/or body occurring at least partially within an associated field may be determined in a 3D basis (and/or a 2D basis). In one example, one or more depth image sensing devices 328 may help determine the relative depth and/or position of multiple physical objects within an associated field. In another example, the movement of a physical object within an associated field may be detected in a 3D sense, and the associated gaming system may respond to such 3D movements, as discussed more fully below. In one example, one or more depth image sensing devices 328 may help determine the identity of one or more physical objects within an associated field. For example, an IR light source may illuminate a player's hand, and an associated CMOS sensor may detect the reflected IR light off of the player's hand, and the processing of the data from the IR light source and/or the CMOS sensor may then recognize the object within the scene as a player's hand.

In one embodiment, a source may be a laser, which may be beamed across an entire field of play, and a sensor may measure reflected light. In one example, the sensor may detect varying colors of reflected light, and an associated game logic controller may interpret the varying colors to determine objects and/or object depths within the field of play. It should be appreciated that laser light sources may, when reflected off of objects, have different characteristics such as color, depending on the size and/or location of the objects. In one embodiment, the source is a light source. In another embodiment, the source is an IR light source. In one embodiment, the sensor may be an IR video graphics array ("VGA") camera.

In one embodiment, one or more depth image sensing devices 328 may include a capacitive proximity sensor, a capacitive displacement sensor, a doppler effect sensor, an eddy-current sensor, an inductive sensor, a laser rangefinder, a magnetic sensor, a magnetic proximity fuse, a passive optical sensor, a passive thermal infrared sensor, a photocell sensor, a radar, a reflection of ionizing radiation sensor, sonar, an ultrasonic sensor, and/or any combination thereof.

In one embodiment, one or more depth image sensing devices 328 may include a video camera. In one example, such a video camera may detect objects and movement. The data from the video camera may be used to determine a relative 2D position and/or movement of such objects.

In one embodiment, one or more depth image sensing devices 328 may include only a single source and/or only a single sensor. In another embodiment, one or more depth image sensing devices 328 may include multiple sources and/or multiple sensors. In another embodiment, one or more depth image sensing devices 328 may include various-sized sources and sensors. For example, a large depth image sensing device may capture larger movements, such as the moving and/or waving of a player's arm, while a smaller depth image sensing device may capture more fine movements, such as the moving of a player's fingers.

In various embodiments, one or more sources, one or more sensors, one or more field edges, one or more fields, one or more field levels, one or more field strengths, and/or any combination thereof may be moved, shifted, strengthened, weakened, varied, and/or modified in any way to obtain one or more scenes.

In one embodiment, one or more scenes (e.g., moving, static, and/or any other type) may be obtained from one or more gaming devices to generate a bigger scene. For example, a first gaming device may obtain a first scene image of three people doing an activity (e.g., playing an interactive game), a second gaming device may obtain a second scene image of two people doing the same activity, and a third gaming device may obtain a third scene image of four people watching the same activity. In one example, these images (e.g., first scene image, second scene image, and/or third scene image) may be combined to generate an integrated scene of all nine people (e.g., three from first scene image, two from second scene image, and four from third scene image).

In one embodiment, one or more depth image sensing devices 328 may include a video camera. In one example, such a video camera may detect objects and movement. The data from the video camera may be used to determine a relative 2D position and/or movement of such objects. In another example, the 2D data may be combined with 3D data to generate one or more scenes.

In one embodiment, one or more depth image sensing devices may include only a single source and/or only a single sensor. In another embodiment, one or more depth image sensing devices may include multiple sources and/or multiple sensors. In another embodiment, one or more depth image sensing devices may include various-sized sources and sensors. In one example, a single gaming system may include one or more larger sized depth image sensing devices and may also include one or more smaller sized depth image sensing devices. In one example, the use of multiple but different-sized sources and sensors may help in capturing both large scene changes as well as small scene changes, which may add both reliability and functionality to such a gaming system. For example, a large depth image sensing device may capture larger movements, such as the moving and/or waving of a player's arm, while a smaller depth image sensing device may capture more fine movements, such as the moving of a player's fingers.

In various examples, the gaming system may utilized one or more small sized depth image sensing devices (e.g., one or more sources and/or one or more sensors), one or more medium sized depth image sensing devices (e.g., one or more sources and/or one or more sensors), one or more large sized depth image sensing devices (e.g., one or more sources and/or one or more sensors), and/or any combination thereof.

Figure 4:
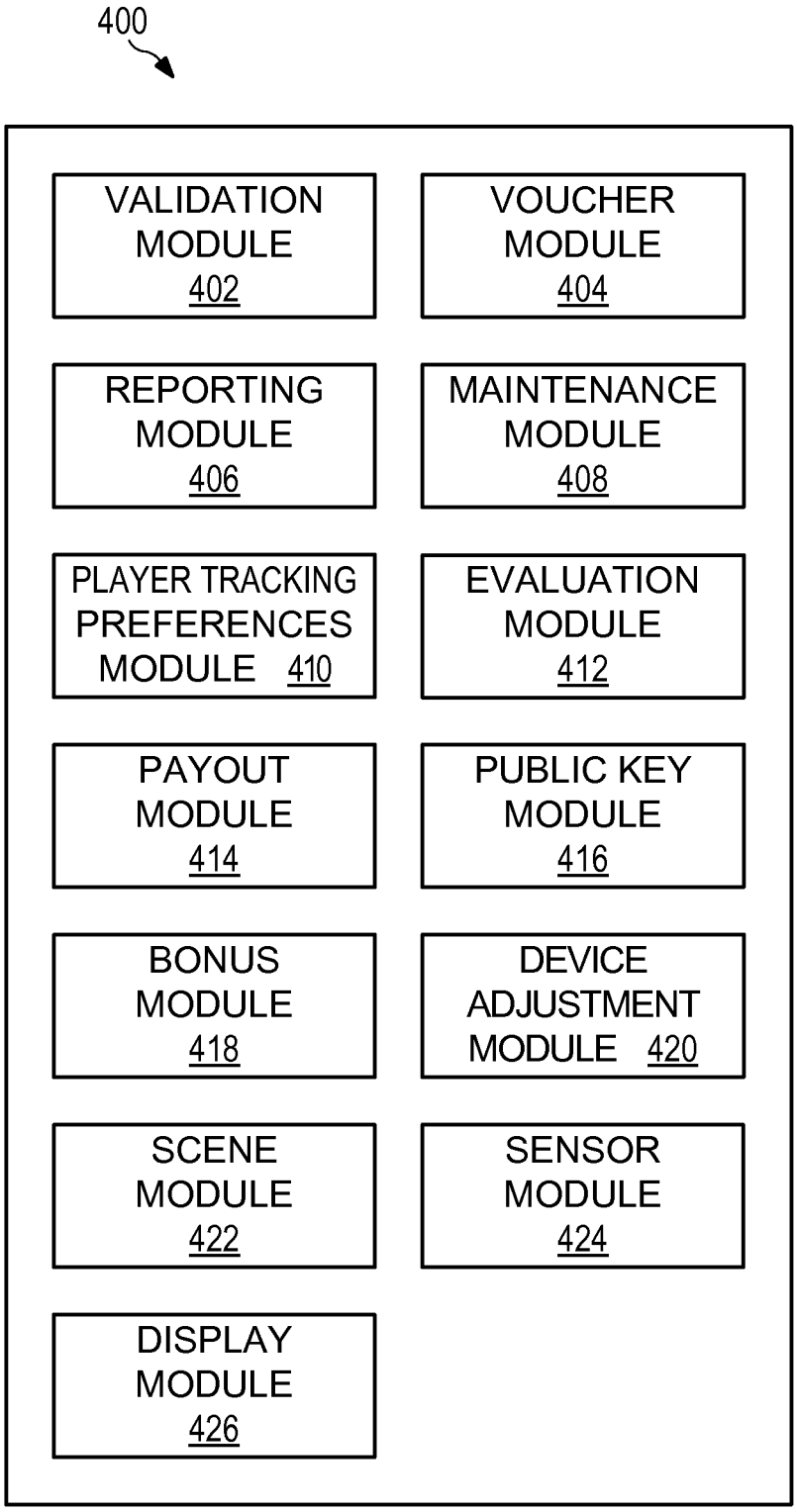
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an evaluation module 412, a payout module 414, a scatter module 416, a bonus module 418, a device adjustment module 420, a scene module 422, a sensor module 424, and/or a display module 426.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Evaluation module 412 may evaluate one or more outcomes for one or more events which may not be based on one or more outcomes for one or more reel games. Evaluation module 412 may evaluate one or more outcomes for one or more events which may be based on one or more outcomes for one or more reel games.

Payout module 414 may determine one or more payouts which may relate to one or more inputs received from the player, electronic gaming device 100, and/or electronic gaming system 200. Payout module 418 may determine one or more payouts based on one or more selections.

Scatter module 416 may determine one or more scatter structures and/or store any data relating to one or more scatter symbols.

Bonus module 418 may generate a bonus game, evaluate the results of the bonus game, trigger bonus game presentations, generate bonus game payouts, and/or display any data relating to the bonus game.

Device adjustment module 420 may generate, compile, transmit, and/or store instructions to move one or more devices, generate commands to move one or more devices, movement history, and/or any combination thereof.

Scene module 422 may generate, compile, transmit, and/or store one or more scene data, one or more scenes, one or more reference models, one or more game play data, one or more player profiles, and/or any combination thereof.

Sensor module 424 may generate, compile, transmit, and/or store any data relating to one or more scene data, one or more scene, and/or any other sensor data. This data may include one or more gestures (e.g., body movement made by one or more players).

Sensor and scene evaluation module may evaluate any data stored on, transmitted to, and/or transmitted from sensor module 424 and scene module 422. Sensor and scene evaluation module may obtain data including one or more gestures (e.g., body movement made by one or more players) from sensor module 424 and compare this data to one or more body reference models, body part reference models, device reference models, gaming device reference models, floor plan reference models, and/or any other reference models from reference models module to determine one or more actions.

Sensor and scene output module may evaluate the combined output of sensor module 424 and scene module 422. Reference models module may generate, compile, transmit, and/or store one or more body reference models, body part reference models, device reference models, gaming device reference models, floor plan reference models, and/or any other reference models which can be utilized by any of the other modules.

Display module 426 may generate, compile, transmit, and/or store one or more display data (e.g., installation date, etc.), display characteristics data, maintenance data (e.g., last maintenance check, maintenance history, etc.), device and/or material movement data, one or more game play data, and/or any combination thereof.

A presentation generation module may generate the presentation data (e.g., visual and audio) relating to one or more game play options. A presentation module may display one or more of the generated presentations.

It should be noted that one or more modules may be combined into one module. Further, there may be one evaluation module where the determined payout does not depend on whether there were any wild symbols, scatter symbols; other reel gaming functionality based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5:
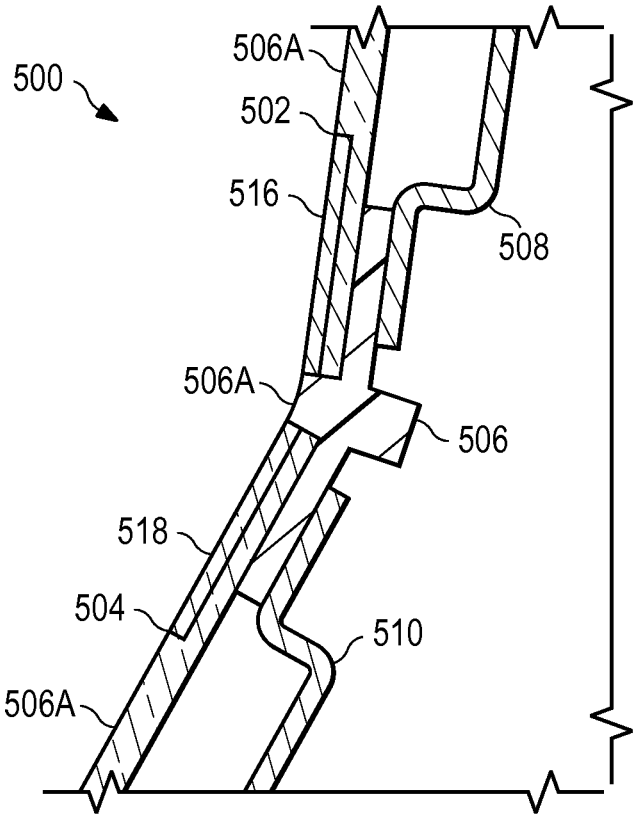
FIG. 5 is partial cross-section view of an adjacent screen mounting system, in accordance with one embodiment, as indicated by cross-section lines of FIG. 6A.
Figure 6A:
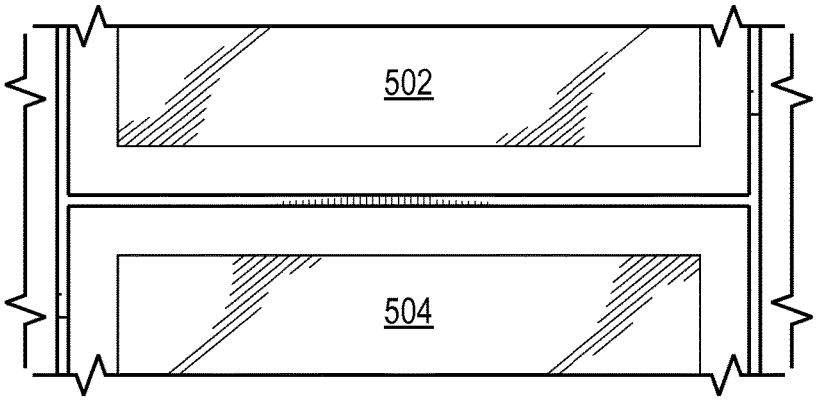
FIG. 6A is an illustration of an exemplary gaming system including adjacent flush mount displays, according to one embodiment.

FIG. 5 is partial cross-section view of an adjacent screen mounting system, in accordance with one embodiment, as indicated by cross-section lines of FIG. 6A. In this example, a first monitor module 502 may be mounted adjacent to a second monitor module 504. In one embodiment, such monitor modules may be mounted in a non-planar manner, as discussed in more detail below. In another embodiment, one or more of the monitor modules may be a liquid crystal display ("LCD"), an organic light emitting display ("OLED"), a plasma display, an organic light emitting transistor ("OLED"), a surface-conduction electron-emitter display ("SED"), a field emission display ("FED"), a quantum dot liquid crystal display, a ferro liquid display ("FLD"), a Thick-film dielectric electroluminescent ("TDEL"), a telescopic pixel display ("TPL"), and/or a laser phosphor display ("LPD").

In one embodiment, a first glass 516 may be mounted in front of first monitor module 502, and/or a second glass 518 may be mounted in front of second monitor module 504. In another embodiment, first glass 516 and/or second glass 518 may be comprised of glass, a glass composite material, sapphire, manufactured sapphire, plastic, and/or other clear material which may also provide protection and/or durability properties. In various embodiments, first glass 516, second glass 518, first monitor module 502, and/or second monitor module 504 may be flush with their surrounding surfaces (e.g., other materials and/or devices).

FIG. 5 also illustrates a first securing strip 506 and one or more additional securing strips 506A. In one embodiment, one or more securing strips may be comprised of plastic. In another embodiment, one or more securing strips may be comprised of rigid or semi-rigid material. In a further embodiment, one or more securing strips may be comprised of a material that has limited and/or no electrical conductivity properties. It is contemplated that securing strips (506 and 506A) may work to help secure a respective monitor module (e.g., 502, 504) and/or a respective glass (e.g., 516, 518) to a gaming system, as discussed in more detail below. It is further contemplated that securing strips may also provide additional advantages, including acting as an electrical insulator between a touchscreen and a metallic frame. It is also contemplated that securing strips (506 and 506A) may also act as a shock absorber for one or more monitor modules (e.g., 502, 504). Gaming systems, such as the one illustrated in FIG. 6A, are often subject to harsh environments which may include intentional or accidental abuse by casino patrons, shocking or jarring movements related to opening and closing of electronic gaming machine doors, and the like, and providing one or more securing elements which help dampen such harsh movements, which may help prolong the longevity of effected electronics and mechanical components.

The one or more shock strips may be comprised of a single color (e.g., opaque black, black, white, red, blue, etc.). In one example, securing strips may be all black. In another embodiment, shock absorption strips may be all white. In another embodiment, discussed more below, one or more shock absorption strips may include branding and/or other messaging. In a further embodiment, one or more shock absorption strips may be comprised of multiple colors. In another example, the one or more shock strips may be colorized and illuminated (e.g., glow). In various examples, the illumination may be a soft glow, a crystal glow, a sparkle glow, any other glowing type, and/or any combination thereof.

FIG. 5 further illustrates an adjacent gasket which may be installed in between adjacent monitor modules (e.g. 502 & 504) and/or adjacent glass (e.g. 516 & 518). In one embodiment, adjacent gasket is comprised of rubber and/or other elastic polymeric material. In another embodiment, adjacent gasket is comprised of plastic, compressed fiber, Polytetrafluoroethylene ("PTFE"), synthetic material, part or wholly recycled material, and/or any combination of one or more thereof. It is contemplated that adjacent gasket may provide shock absorbing properties and/or sealing properties for one or more monitor modules (e.g., 502 & 504) and/or one or more glass components (e.g. 516 & 518). It is further contemplated that adjacent gasket may provide protection to sensitive components, such as a monitor module (e.g. 512 or 514) from foreign debris and/or liquids. It is understood that electronic gaming systems must provide dependable service under rigorous conditions, such as constant use by casino patrons, exposure to smoke and spilled beverages, and other such environmental exposure conditions one might expect in a casino, and it is expressly contemplated that providing one or more adjacent gaskets positioned in between flush mounted monitors may provide significant benefits in preventing such contaminants from affecting one or more components of an electronic gaming system.

FIG. 5 further illustrates one embodiment where, positioned at the backside of first monitor module 502, a first support structure 508 and positioned at the backside of second monitor module 504, a second support structure 510 are arranged. In one embodiment, one or more such support structures may be comprised of rigid or semi-rigid material. In one example, such support structures may be comprised of metal, plastic, wood, rubber, carbon fiber, and/or any combination thereof. In one embodiment, one or more support structures (e.g., 508 and/or 510) may not be attached directly to an associated monitor module (e.g., 502 and/or 504), but rather may be attached directly to one or more adjacent gaskets. In one example, first support structure 508 is attached, via adhesive (as discussed in more detail below) to adjacent gasket, which may itself be attached to first glass 516, and collectively such an arrangement may "sandwich" the associated first monitor module 502 and/or otherwise secure first monitor module 502 in place. In another example, first support structure 508 may be attached via a mechanical securing device (such as a nail, screw, rivet, etc.) to one or more elements of an associated electronic gaming system.

FIG. 6A is an illustration of an exemplary gaming system including adjacent flush mount displays, according to one embodiment. As illustrated at FIG. 6A, the cross-section lines represent a limited view of one embodiment of adjacently flush mounted display devices, as further illustrated in FIG. 5. As is evident from FIG. 6A, one embodiment as disclosed herein may include adjacent flush mounted displays arranged in a non-planar manner.

Figure 6B:
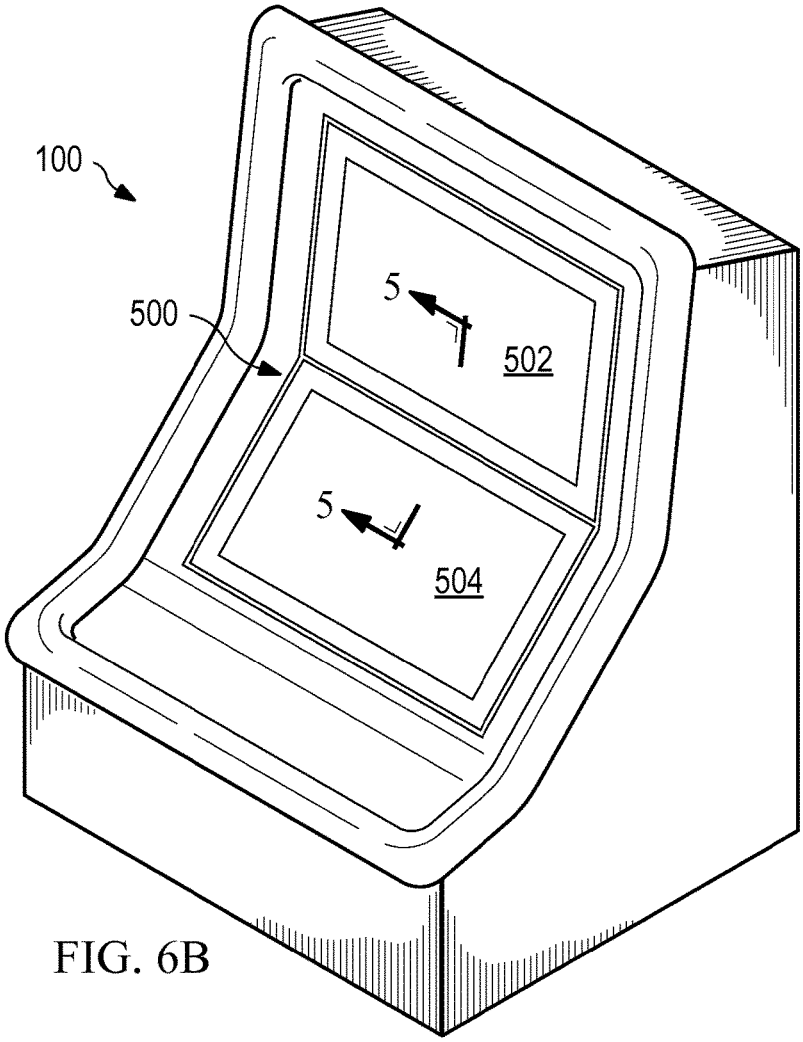
FIG. 6B is another illustration of an exemplary gaming system including adjacent flush mount displays, according to one embodiment.

In FIG. 6B, another illustration of an exemplary gaming system including adjacent flush mount displays is shown, according to one embodiment. In one example, first monitor module 502 and second monitor module 504 may be positioned at various angles (e.g. 0 to 180 degrees) to each other. For example, first monitor module 502 and second monitor module 504 may be positioned at a 1 percent angle to each other. In another example, first monitor module 502 and second monitor module 504 may be positioned at a 5 percent angle to each other. In another example, first monitor module 502 and second monitor module 504 may be positioned at a 7 percent angle to each other. In another example, first monitor module 502 and second monitor module 504 may be positioned at a 10 percent angle to each other. In another example, first monitor module 502 and second monitor module 504 may be positioned at a 13 percent angle to each other. In another example, first monitor module 502 and second monitor module 504 may be positioned at a 15 percent angle to each other. In another example, first monitor module 502 and second monitor module 504 may be positioned at an 18 percent angle to each other. In another example, first monitor module 502 and second monitor module 504 may be positioned at a 20 percent angle to each other. In another example, first monitor module 502 and second monitor module 504 may be positioned at a 25 percent angle to each other. In another example, first monitor module 502 and second monitor module 504 may be positioned at a 26.5 percent angle to each other. In another example, first monitor module 502 and second monitor module 504 may be positioned at a 28.3 percent angle to each other. In another example, first monitor module 502 and second monitor module 504 may be positioned at a 30 percent angle to each other. In another example, first monitor module 502 and second monitor module 504 may be positioned at a 36 percent angle to each other. In another example, first monitor module 502 and second monitor module 504 may be positioned at a 45 percent angle to each other. In another example, first monitor module 502 and second monitor module 504 may be positioned at a 49 percent angle to each other. In another example, first monitor module 502 and second monitor module 504 may be positioned at a 50 percent angle to each other. In another example, first monitor module 502 and second monitor module 504 may be positioned at a 53 percent angle to each other. In another example, first monitor module 502 and second monitor module 504 may be positioned at a 55 percent angle to each other. In another example, first monitor module 502 and second monitor module 504 may be positioned at a 67 percent angle to each other. In another example, first monitor module 502 and second monitor module 504 may be positioned at a 70 percent angle to each other. In another example, first monitor module 502 and second monitor module 504 may be positioned at a 73 percent angle to each other. In another example, first monitor module 502 and second monitor module 504 may be positioned at a 75 percent angle to each other. In another example, first monitor module 502 and second monitor module 504 may be positioned at an 88 percent angle to each other. In another example, first monitor module 502 and second monitor module 504 may be positioned at a 90 percent angle to each other. In another example, first monitor module 502 and second monitor module 504 may be positioned at a 91 percent angle to each other. In another example, first monitor module 502 and second monitor module 504 may be positioned at a 95 percent angle to each other. In another example, first monitor module 502 and second monitor module 504 may be positioned at a 100 percent angle to each other. In another example, first monitor module 502 and second monitor module 504 may be positioned at a 110 percent angle to each other. In another example, first monitor module 502 and second monitor module 504 may be positioned at a 113.1 percent angle to each other. In another example, first monitor module 502 and second monitor module 504 may be positioned at a 115 percent angle to each other. In another example, first monitor module 502 and second monitor module 504 may be positioned at a 118 percent angle to each other. In another example, first monitor module 502 and second monitor module 504 may be positioned at a 120 percent angle to each other. In another example, first monitor module 502 and second monitor module 504 may be positioned at a 125 percent angle to each other. In another example, first monitor module 502 and second monitor module 504 may be positioned at a 125.2 percent angle to each other. In another example, first monitor module 502 and second monitor module 504 may be positioned at a 127 percent angle to each other. In another example, first monitor module 502 and second monitor module 504 may be positioned at a 130 percent angle to each other. In another example, first monitor module 502 and second monitor module 504 may be positioned at a 143 percent angle to each other. In another example, first monitor module 502 and second monitor module 504 may be positioned at a 145 percent angle to each other. In another example, first monitor module 502 and second monitor module 504 may be positioned at a 148 percent angle to each other. In another example, first monitor module 502 and second monitor module 504 may be positioned at a 150 percent angle to each other. In another example, first monitor module 502 and second monitor module 504 may be positioned at a 165 percent angle to each other. In another example, first monitor module 502 and second monitor module 504 may be positioned at a 170 percent angle to each other. In another example, first monitor module 502 and second monitor module 504 may be positioned at a 172 percent angle to each other. In another example, first monitor module 502 and second monitor module 504 may be positioned at a 180 percent angle to each other. In another example, first monitor module 502 and second monitor module 504 may be positioned at a 183 percent angle to each other. In another example, first monitor module 502 and second monitor module 504 may be positioned at a 185 percent angle to each other. In another example, first monitor module 502 and second monitor module 504 may be positioned at a 189 percent angle to each other. In another example, first monitor module 502 and second monitor module 504 may be positioned at a 220 percent angle to each other. In another example, first monitor module 502 and second monitor module 504 may be positioned at a 225 percent angle to each other.

In another example, one or more gaskets, shock absorption material, electrical isolation material, and/or any other material may be utilized between first monitor module 502, second monitor module 504, and/or any other device and/or any other monitoring device to provide electrical isolation, shock absorption, sealing functionality, reduced material wear, and/or allow for material expansion and/or material contractions. In another example, first monitor module 502, second monitor module 504, and/or any other device and/or any other monitoring device may be located in the same plane and/or flush with each other.

Figure 7A:
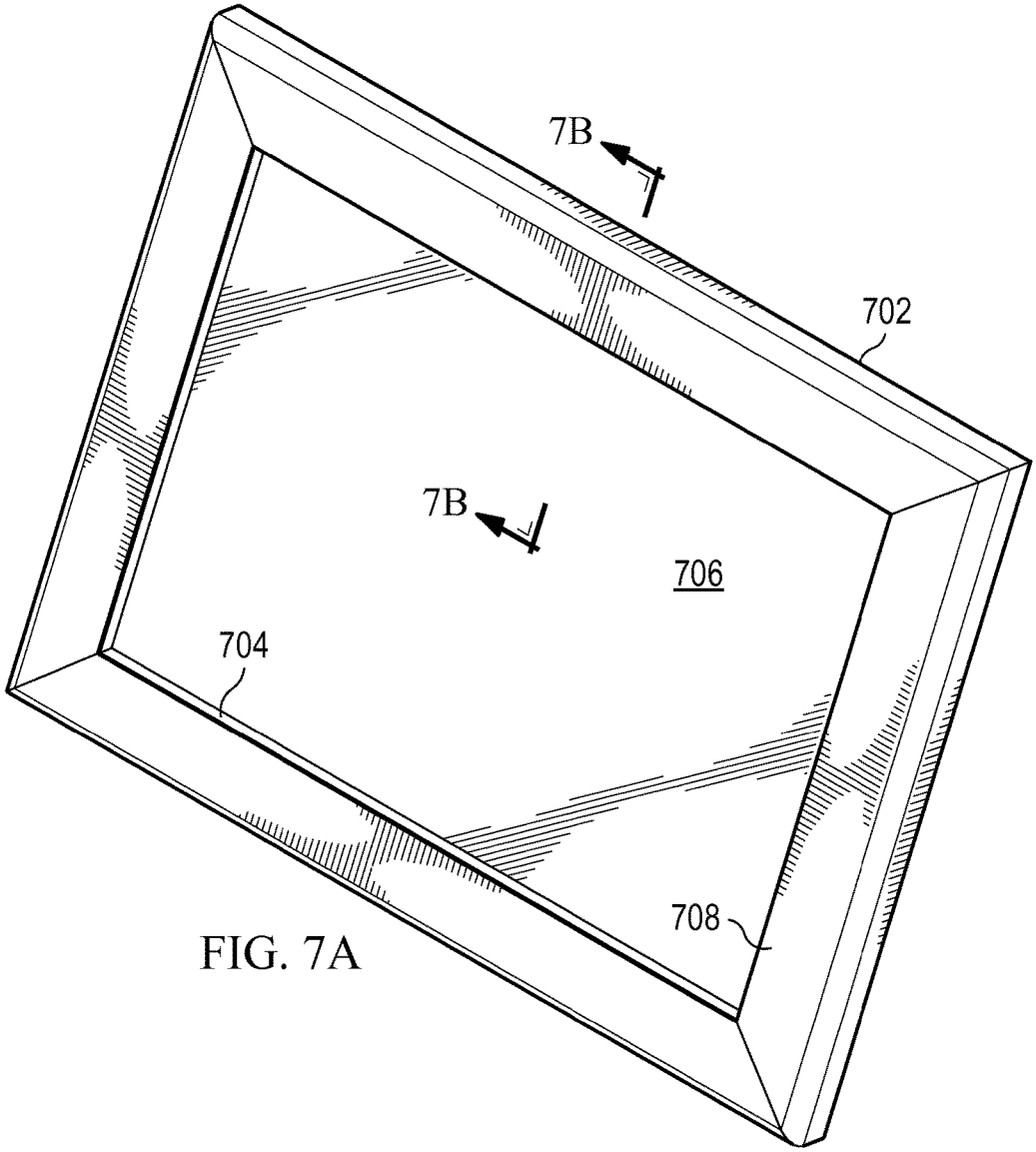
FIG. 7A is an illustration of a display mounting configuration.
Figure 7B:
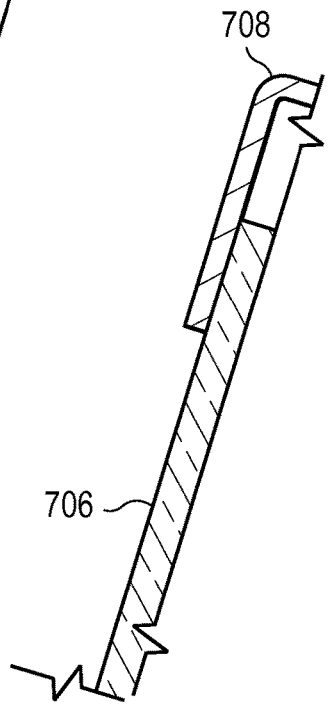
FIG. 7B is a partial cross-section view of the display mounting configuration of FIG. 7A.

FIG. 7A is an illustration of a display mounting configuration. FIG. 7A further includes a cross section area, which is further illustrated in FIG. 7B. In one embodiment, a first display assembly, generally shown at 702, may include front screen 706. Front screen 706 may be comprised of glass, plastic, and/or other clear material. In a further embodiment, first display assembly 702 may include a front securing bracket 708. Front securing bracket 708 may be comprised of rigid and/or semi-rigid material, such as metal, rubber, plastic, and/or like material. In another embodiment, front securing bracket 708 may include a raised edge 704. Raised edge 704 may assist a player in understanding the boundaries of a display but has significant ergonomic disadvantages (e.g., player's hands getting tired, hurt, etc.). For example, front screen 706 may include touchscreen functionality, and raised edge 704 may rub along a player's hand during one or more interactions. Further, raised edge 704 may provide an area for debris to collect, which may in turn cause undesirable effects, such as a dirty and/or unclean appearance of first display assembly 702, or perhaps even cause interference for an associated touchscreen which could cause such touchscreen to work improperly. In another example, the touch screen material may include a low energy surface coating, which may be accomplished utilizing flouropolymers. These coatings may be clear, colorless treatments for one or more surfaces (e.g., glass, tile, plastic, etc.). These flouropolymers may react with the one or more surfaces to generate a low surface coating. This has the benefit of reducing the probability of that the one or more surface will wetted out with liquids. Another benefit is that soils and liquids do not stick to the one or more surface but instead slide-off, which reduces any build-up on the one or more surfaces. In addition, the coating helps to the one or more surfaces resist strains. The coating also reduces any sanitary requirements. These configurations may provide a soft glide on the glass surface (and/or any other surface) that is ergonomically comfortable for the player's dragging fingers.

Figure 8A:
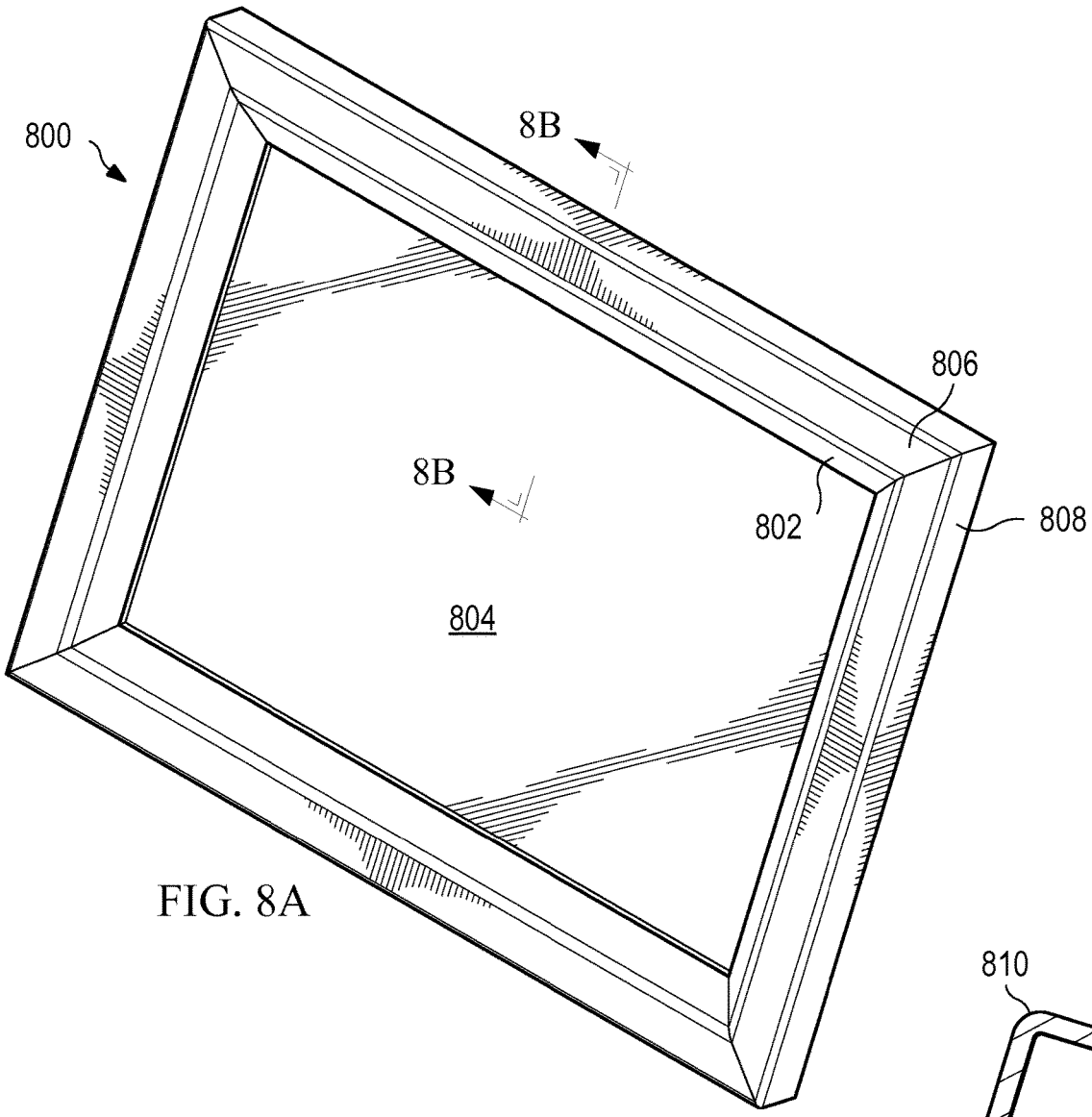
FIG. 8A is an illustration of another display mounting configuration.
Figure 8B:
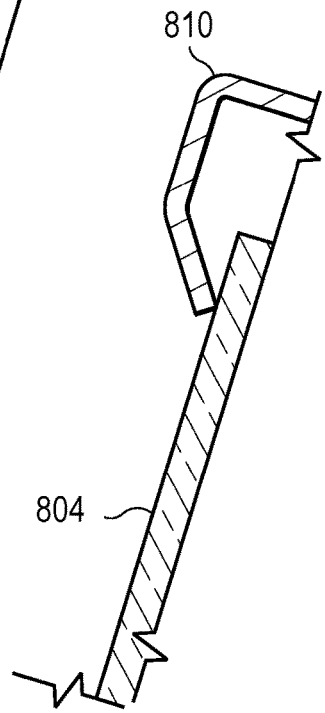
FIG. 8B is a partial cross-section view of the display mounting configuration of FIG. 8A.

FIG. 8A is another illustration of another display mounting configuration. FIG. 8A further includes a cross section area, which is further illustrated in FIG. 8B. In one embodiment, a second display assembly, generally shown at 800, may include front screen 804. Front screen 804 may be comprised of glass, plastic, and/or other clear material. In a further embodiment, second display assembly 800 may include a securing frame 808. Securing frame 808 may be comprised of rigid or semi-rigid material, such as metal, rubber, plastic, and/or like material. In another embodiment, securing frame 808 may include first raised feature 806 and a second raised feature 810. In a further embodiment, securing frame 808 may include a raised edge 802. These raised features create boundaries of a display and have significant ergonomic disadvantages (e.g., player's hands getting tired, hurt, etc.). For example, these raised areas may rub along a player's hand during one or more interactions. Further, these raised areas may provide an area for debris to collect, which may in turn cause undesirable effects, such as a dirty and/or unclean appearance of display assembly, and/or perhaps even cause interference for an associated touchscreen which could cause such touchscreen to work improperly.

Figure 9A:
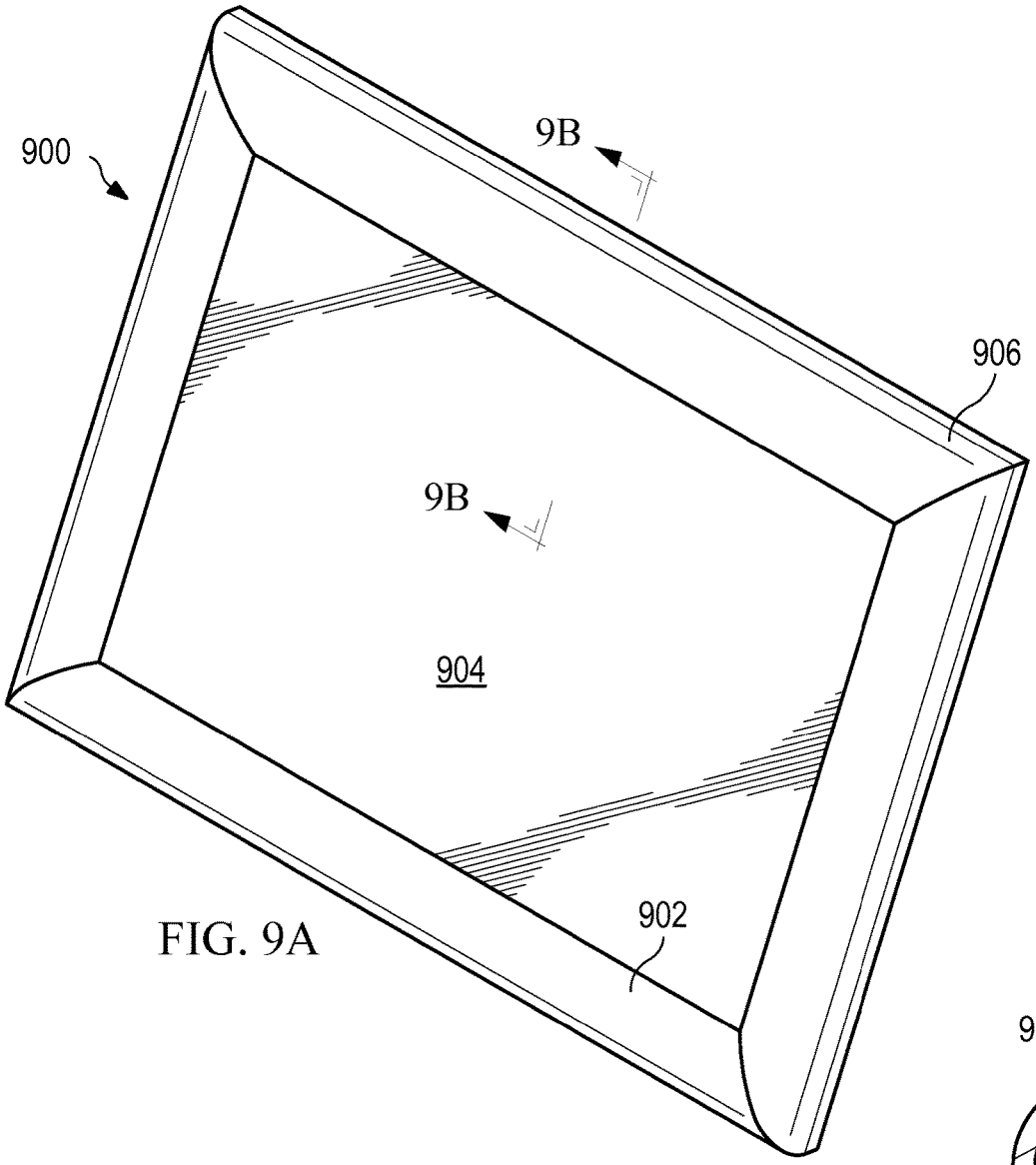
FIG. 9A is an illustration of another display mounting configuration.
Figure 9B:
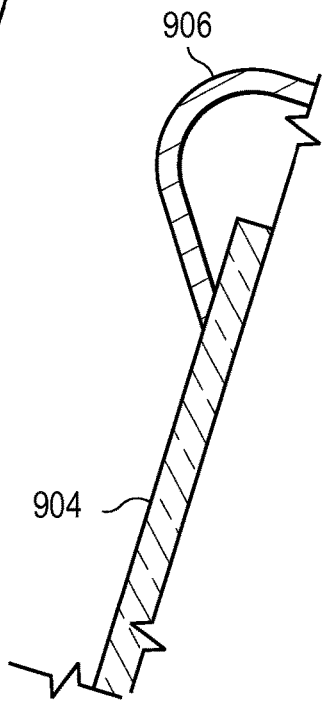
FIG. 9B is a partial cross-section view of the display mounting configuration of FIG. 9A.

FIG. 9A is a further illustration of another display mounting configuration. FIG. 9A further includes a cross section area, which is further illustrated in FIG. 9B. In one embodiment, a third display assembly, generally shown at 900, may include front screen 904. Front screen 904 may be comprised of glass, plastic, or other clear material. In a further embodiment, third display assembly 900 may include a securing frame 906. Securing frame 906 may be comprised of rigid or semi-rigid material, such as metal, rubber, plastic, or like material. In another embodiment, securing frame 906 may include a raised edge 902. These raised features create boundaries of a display and have significant ergonomic disadvantages (e.g., player's hands getting tired, hurt, etc.). For example, these raised areas may rub along a player's hand during one or more interactions. Further, these raised areas may provide an area for debris to collect, which may in turn cause undesirable effects, such as a dirty and/or unclean appearance of display assembly, and/or perhaps even cause interference for an associated touchscreen which could cause such touchscreen to work improperly.

Figure 10:
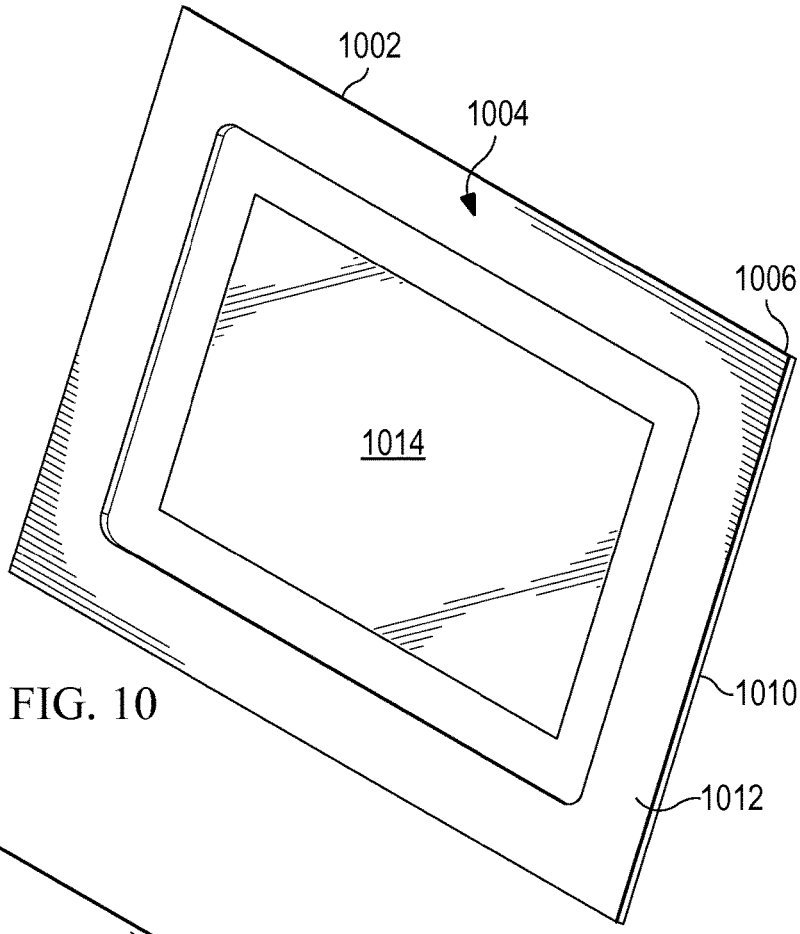
FIG. 10 is an illustration of an exemplary flush mounted display screen, in accordance with one or more embodiments disclosed herein.
Figure 11:
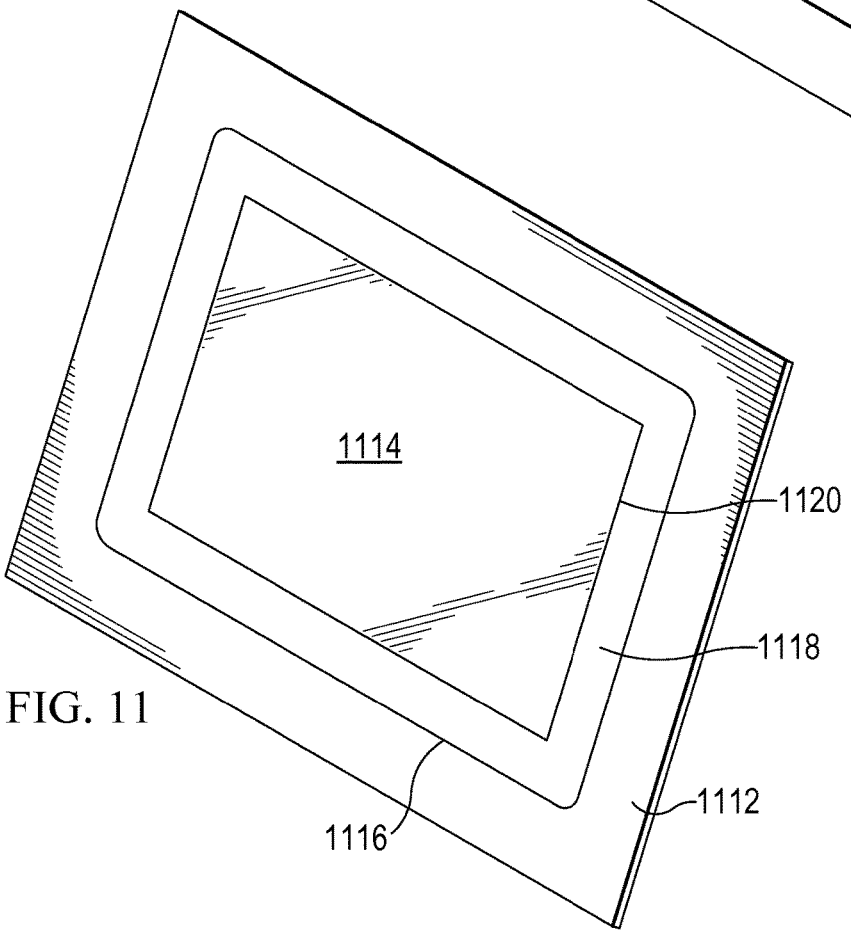
FIG. 11 is another illustration of an exemplary flush mounted display screen, in accordance with one or more embodiments disclosed herein.

FIG. 10 illustrates another example of a flush mounted display, in accordance with one embodiment herein. FIG. 11 illustrates a further example of a flush mounted display in accordance with another embodiment herein. It is to be understood that FIGS. 10 & 11 represent different embodiments, and that they are illustrated with common elements strictly as representative examples, and such examples are not to be construed to limit either embodiment.

A first flush mounted display, generally shown at 1002, may include a front glass 1014. As discussed previously, front glass 1014 may be comprised of glass, a glass composite material, sapphire, manufactured sapphire, plastic, and/or other clear material which may also provide protection and/or durability properties. In one embodiment, front glass 1014 may include touchscreen functionality.

First flush mounted display 1002 may include a frame 1012. In one embodiment, frame is comprised of metal or partially metallic material. It is contemplated that metal and/or partially metallic material may provide desirable properties, including being durable while also maintaining a desired appearance. For example, frame 1012 may be comprised of polished aluminum, which may withstand constant use by casino patrons, repeated cleaning by casino staff, and still maintain a desired polished appearance. In another embodiment, frame 1012 may be comprised of plastic. In a further embodiment, frame 1012 may be comprised of other rigid material. Frame 1012 is illustrated with an exemplary frame edge 1006 and a frame depth 1010. In another embodiment, frame 1012 may accommodate a camera 1004. Camera 1004 may be a still camera, a video camera, a web-enabled camera, a digital camera, and/or any combination thereof.

As further illustrated in FIG. 11, a securing strip 1118 (and/or 1206) may have a first flush edge 1116 and a second flush edge 1120, as discussed in more detail below. In one example, second flush edge 1120 forms a first flush surface with front glass 1114. In another example, first flush edge 1116 forms a second flush surface with frame 1112. In one embodiment, first flush edge 1116 and/or second flush edge 1120 are visibly perceptible. In one example, one or more such visually perceptible edges may assist a player in understanding the effective boundaries of an associated display. For example, front glass 1114 may include touchscreen functionality, and first flush edge 1116 may assist a player in recognizing when their physical interactions with an associated display assembly are inside or outside of an associated field of recognition. In another embodiment, first flush edge 1116 and/or second flush edge 1120 are generally not perceptible by a person's touch only. For example, second flush edge 1120 may not be perceptible by a player if they were to generally run their finger over the edge in the standard course of playing an electronic gaming system, but may in some circumstances be perceptible by a player if they were intended (e.g., designed with bumps to allow for the surfaces to be perceived, etc.) on feeling such second flush edge 1120.

Figure 12:
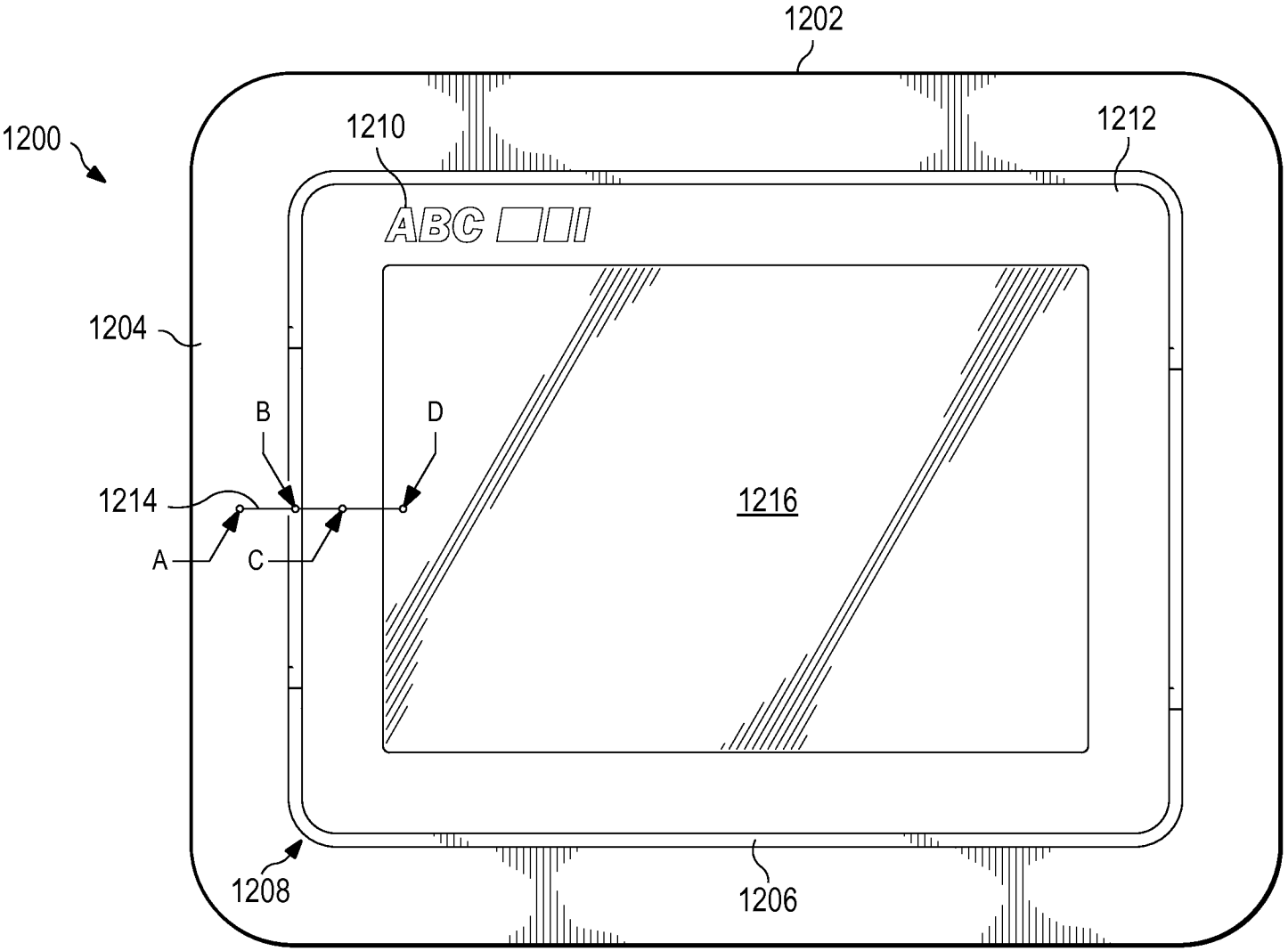
FIG. 12 is another illustration of an exemplary flush mounted display screen, in accordance with one or more embodiments disclosed herein.

FIG. 12 illustrates another exemplary flush mounted display screen, in accordance with one embodiment disclosed herein. In accordance with one embodiment, a flush mounted display, generally shown at 1200, may include a frame 1204. As previously discussed herein, frame 1204 may be comprised of metal, plastic, and/or other rigid or semi-rigid material. Frame 1204 is illustrated in the present embodiment having a frame edge 1202.

FIG. 12 also illustrates flush mounted display 1200 having one or more strips (e.g., 1206, 1212, etc.) which may assist in securing front screen 1216 to frame 1204. In one embodiment, one or more securing strips may be comprised of plastic. In another embodiment, one or more securing strips may be comprised of rigid or semi-rigid material. In a further embodiment, one or more securing strips may be comprised of a material (e.g., an insulator) that has limited and/or no electrical conductivity properties. It is contemplated that one or more securing strips may work to help secure a respective monitor module and/or a respective front screen 1216 to a gaming system. It is further contemplated that one or more securing strips may also provide additional advantages, including acting as an electrical insulator between a touchscreen interface (understood to possibly being combined with front screen 1216) and a frame 1204 (which may be metallic and/or otherwise have electrical conductivity properties). It is also contemplated that one or more securing strips may also act as a shock absorber and/or sealant for an associated display module (e.g., 502 and/or 504 of FIG. 5). Gaming systems, such as the one illustrated in FIG. 6A, are often subject to harsh environments which may include intentional or accidental abuse by casino patrons, shocking or jarring movements related to opening and closing of electronic gaming machine doors, and the like, and providing one or more elements which help dampen such harsh movements may help prolong the longevity of effected electronics and mechanical components.

Further, one or more of the securing strips, first glass, second glass, first display, and/or second display may be moved via one or more movement devices (e.g., motors, springs, etc.). In another example, one or more of the securing strips, first glass, second glass, first display, second display, and/or any other devices may be moved based on a player's input and/or a player's preference. Further, one or more of the securing strips, first glass, second glass, first display, second display, and/or any other devices may be moved for a maintenance procedure and/or any other device procedure (e.g., game play, promotion presentation, etc.).

In another embodiment, one or more securing strips may be comprised of a single color. In one example, securing strips may be all black. In another embodiment, one or more securing strips may be all white. In another embodiment, one or more securing strips may include border display.

In another example, border customization 1210 may be utilized to advertise the brand of the electronic gaming system manufacturer, the branding of the associated gaming system theme, and/or any other desired display. In another embodiment, border customization 1210 may be added material to one or more securing strips, such as a decal, paint, overlay, and/or other such decorative process. In a further embodiment, border customization 1210 may be implemented in the forming or molding process for any device. For example, border customization 1210 may be formed by placing elements of a first material in mold, and then pouring a second material into the mold to form the rest of the device. In still a further embodiment, border customization 1210 may be formed by removing and/or otherwise not including a portion of the device. For example, device may, in a first state, not include part or all of a border customization 1210, but then a punch or other device removes part of the device in order to leave a punched out border customization 1210. In another example, device is formed in the first place without the material, the absence of which creates the desired border customization 1210.

Illustrated in FIG. 12 is an insulating edge 1206. As discussed above, in one or more embodiments, one or more securing strips may act as an electrical insulator between a touchscreen (generally shown as front screen 1216) and frame 1204, which is contemplated to provide significant benefits. In the present example, insulating edge 1206 is illustrated as being visually perceptible for purposes to illustrating the present embodiment, and it is to be understood that such an insulating edge may and/or may not be visually perceptible.

In one embodiment, one or more securing strips and frame 1204 may form rounded corner 1208. In another embodiment, one or more securing strips and frame 1204 form any other desirable corner style. In a further embodiment, a continuous surface, generally shown at 1214 and associated points A-D, is formed by the assembly of the front screen 1216, one or more securing strips, insulating edge 1206 (again, illustrated for clarity), and frame 1204. As discussed above, in one embodiment, continuous surface 1214 are not generally perceptible by a player's fingers/touch.

In an example, a display 1202 may include frame 1204, insulating edge 1206, rounded corner 1208, border customization 1210, a silk-screen area 1212, continuous surface 1214, and front screen 1216. Continuous surface 1214 may include areas in frame 1204, insulating edge 1206, rounded corner 1208, border customization 1210, silk-screen area 1212, front screen 1216, and/or any other device and/or material. Continuous surface 1214 may be in the same plane and may have a flush surface. This flush surface may not be perceivable to the player. In another example, this flush surface may be perceivable to the player based on utilizing different colors (and/or adding bumps, etc.) for different areas. This flush surface may be flat, curved, and/or any combination thereof.

Display 1202, frame 1204, insulating edge 1206, rounded corner 1208, border customization 1210, silk-screen area 1212, continuous surface 1214, front screen 1216, gaskets, and/or any other area may be utilized as an electrical isolator, mechanical isolator, and/or a shock absorption device.

Figure 13:
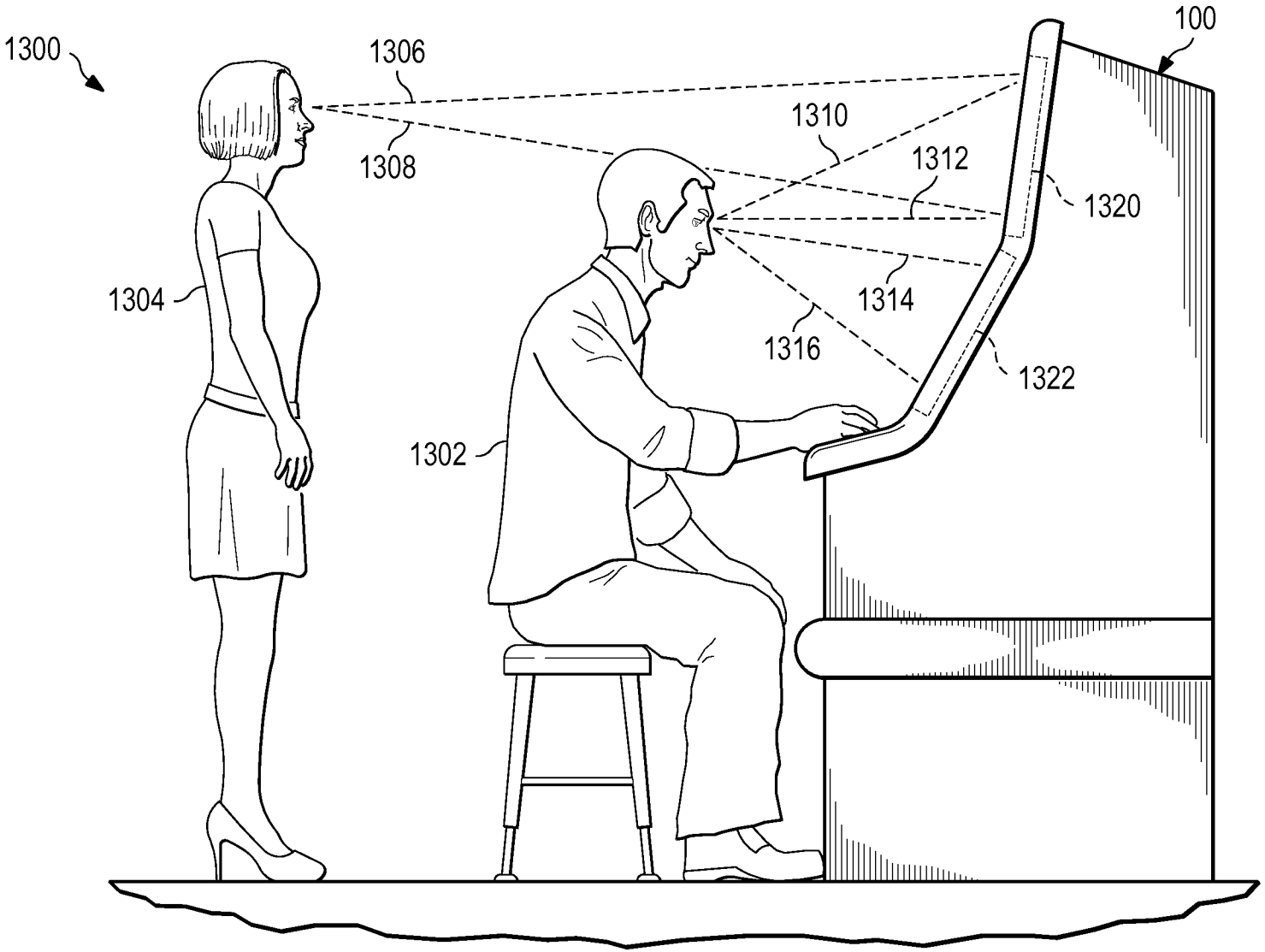
FIG. 13 is another illustration of an exemplary gaming system including adjacent flush mount displays, according to one embodiment.

FIG. 13 is another illustration of an exemplary gaming system including adjacent flush mount displays, according to one embodiment. In the present embodiment, an electronic gaming machine 100 may include a second display assembly 1320 at a more vertical orientation than an adjacent first display assembly 1322. It is contemplated that with such an arrangement, particular advantages may be realized. Specifically, in a typical spectator scenario, generally illustrated at 1300, a spectator 1304 may still be to view second display 1320 while a seated player 1302 may be able to view both first display 1322 and second display 1320. In one embodiment, first display 1322 and/or second display 1320 may be a flush mounted display assembly as disclosed herein.

Specifically, in a typical spectator scenario 1300, a spectator may have a spectator field of view (FOV), generally delineated by edges 1306 and 1308, of second display assembly 1320. Additionally, in such a typical spectator scenario 1300, a seated player 1302 may have two FOV's, and specifically a player first FOV (generally outlined by edges 1314 and 1316) and a player second FOV (generally outlined by edges 1310 and 1312). It is contemplated that such an arrangement of first display assembly 1322 and second display assembly 1320 may promote interest by other casino patrons as they can easily view second display assembly 1320, which in turn may create interest in the electronic gaming system 100 and excitement to play the associated game. It is further contemplated that such an arrangement, as discussed in more detail below, may provide significant advantages in providing similar optimal viewing angles for multiple persons located around an electronic gaming system.

The one or more flush screens may be positioned at any angle relative to each other. In various examples, first monitor module 502 and second monitor module 504 may be positioned at various angles (e.g. 0 to 360 degrees) to each other. For example, first monitor module 502 and second monitor module 504 may be positioned at a 4 percent angle to each other. In another example, first monitor module 502 and second monitor module 504 may be positioned at a 6 percent angle to each other. In another example, first monitor module 502 and second monitor module 504 may be positioned at an 8 percent angle to each other. In another example, first monitor module 502 and second monitor module 504 may be positioned at a 195 percent angle to each other. In another example, first monitor module 502 and second monitor module 504 may be positioned at a 235 percent angle to each other. In another example, first monitor module 502 and second monitor module 504 may be positioned at a 315 percent angle to each other. In another example, first monitor module 502 and second monitor module 504 may be positioned at a 318 percent angle to each other. In another example, first monitor module 502 and second monitor module 504 may be positioned at a 355 percent angle to each other. In another example, first monitor module 502 and second monitor module 504 may be positioned at a 125.1 percent angle to each other. In another example, first monitor module 502 and second monitor module 504 may be positioned at a 126.5 percent angle to each other. In another example, first monitor module 502 and second monitor module 504 may be positioned at a 281.3 percent angle to each other. In another example, first monitor module 502 and second monitor module 504 may be positioned at a 130 percent angle to each other. In another example, first monitor module 502 and second monitor module 504 may be positioned at a 137 percent angle to each other. In another example, first monitor module 502 and second monitor module 504 may be positioned at a 145 percent angle to each other. In another example, first monitor module 502 and second monitor module 504 may be positioned at a 149 percent angle to each other. In another example, first monitor module 502 and second monitor module 504 may be positioned at a 150 percent angle to each other. In another example, first monitor module 502 and second monitor module 504 may be positioned at a 153 percent angle to each other. In another example, first monitor module 502 and second monitor module 504 may be positioned at a 255 percent angle to each other. In another example, first monitor module 502 and second monitor module 504 may be positioned at a 267 percent angle to each other. In another example, first monitor module 502 and second monitor module 504 may be positioned at a 70 percent angle to each other. In another example, first monitor module 502 and second monitor module 504 may be positioned at a 173 percent angle to each other. In another example, first monitor module 502 and second monitor module 504 may be positioned at a 175 percent angle to each other. In another example, first monitor module 502 and second monitor module 504 may be positioned at a 188.8 percent angle to each other. In another example, first monitor module 502 and second monitor module 504 may be positioned at a 90 percent angle to each other. In another example, first monitor module 502 and second monitor module 504 may be positioned at a 91 percent angle to each other. In another example, first monitor module 502 and second monitor module 504 may be positioned at a 95 percent angle to each other. In another example, first monitor module 502 and second monitor module 504 may be positioned at a 100 percent angle to each other. In another example, first monitor module 502 and second monitor module 504 may be positioned at a 210 percent angle to each other. In another example, first monitor module 502 and second monitor module 504 may be positioned at a 113.3 percent angle to each other. In another example, first monitor module 502 and second monitor module 504 may be positioned at a 115 percent angle to each other. In another example, first monitor module 502 and second monitor module 504 may be positioned at a 118 percent angle to each other. In another example, first monitor module 502 and second monitor module 504 may be positioned at a 133 percent angle to each other. In another example, first monitor module 502 and second monitor module 504 may be positioned at a 105 percent angle to each other. In another example, first monitor module 502 and second monitor module 504 may be positioned at a 125.2 percent angle to each other. In another example, first monitor module 502 and second monitor module 504 may be positioned at a 127 percent angle to each other. In another example, first monitor module 502 and second monitor module 504 may be positioned at a 130 percent angle to each other. In another example, first monitor module 502 and second monitor module 504 may be positioned at a 143 percent angle to each other. In another example, first monitor module 502 and second monitor module 504 may be positioned at a 145 percent angle to each other. In another example, first monitor module 502 and second monitor module 504 may be positioned at a 148 percent angle to each other. In another example, first monitor module 502 and second monitor module 504 may be positioned at a 151 percent angle to each other. In another example, first monitor module 502 and second monitor module 504 may be positioned at a 166 percent angle to each other. In another example, first monitor module 502 and second monitor module 504 may be positioned at a 171 percent angle to each other. In another example, first monitor module 502 and second monitor module 504 may be positioned at a 172 percent angle to each other. In another example, first monitor module 502 and second monitor module 504 may be positioned at a 180 percent angle to each other. In another example, first monitor module 502 and second monitor module 504 may be positioned at a 183 percent angle to each other. In another example, first monitor module 502 and second monitor module 504 may be positioned at a 185 percent angle to each other. In another example, first monitor module 502 and second monitor module 504 may be positioned at a 189 percent angle to each other. In another example, first monitor module 502 and second monitor module 504 may be positioned at a 220.1 percent angle to each other. In another example, first monitor module 502 and second monitor module 504 may be positioned at a 225.5 percent angle to each other.

Figure 14:
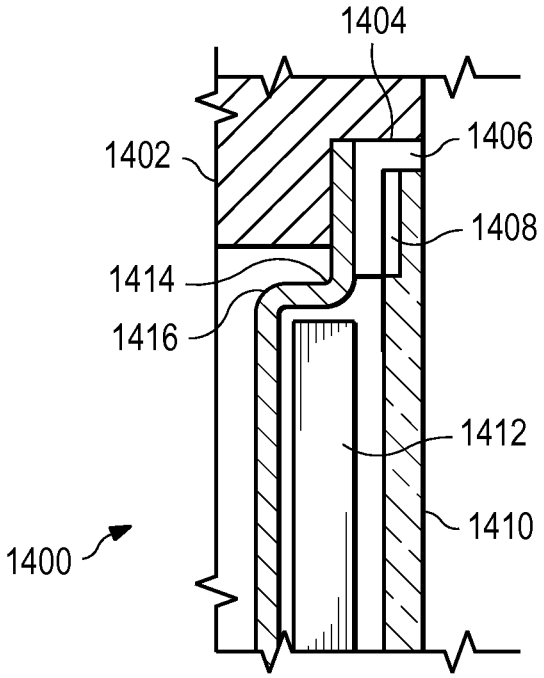
FIG. 14 is a partial cross-section view of a display mounting configuration, in accordance with one or more embodiments disclosed herein.

FIG. 14 is partial cross-section view of a flush mounted screen mounting system, in accordance with one embodiment. In this example, a monitor module 1412 may be mounted within a cabinet body 1402. In one embodiment, monitor module 1412 may be a liquid crystal display ("LCD"), an organic light emitting display ("OLED"), a plasma display, an organic light emitting transistor ("OLED"), a surface-conduction electron-emitter display ("SED"), a field emission display ("FED"), a quantum dot liquid crystal display, a ferro liquid display ("FLD"), a Thick-film dielectric electroluminescent ("TDEL"), a telescopic pixel display ("TPL"), and/or a laser phosphor display ("LPD").

In one embodiment, glass 1410 may be mounted in front of monitor module 1412. In another embodiment, glass 1410 may be comprised of glass, a glass composite material, sapphire, manufactured sapphire, plastic, and/or other clear material which may also provide protection and/or durability properties.

FIG. 14 also illustrates gasket 1406 which may be installed in between glass 1410, cabinet body 1402, and/or support structure 1416. In one embodiment, gasket 1406 is comprised of rubber and/or other elastic polymeric material. In another embodiment, gasket 1406 is comprised of plastic, compressed fiber, Polytetrafluoroethylene ("PTFE"), synthetic material, part or wholly recycled material, and/or any combination of one or more thereof. It is contemplated that gasket 1406 may provide shock absorbing properties for monitor module 1412 and/or glass 1410. It is further contemplated that gasket 1406 may provide protection to sensitive components, such as a monitor module 1412, from foreign debris and/or liquids. It is understood that electronic gaming systems must provide dependable service under rigorous conditions, such as constant use by casino patrons, exposure to smoke and spilled beverages, and other such environmental exposure conditions one might expect in a casino, and it is expressly contemplated that providing gasket 1406 may provide significant benefits by preventing part or all of such contaminants from damaging internal components of the associated electronic gaming system.

FIG. 14 further illustrates one embodiment where, positioned at the backside of monitor module 1412, support structure 1416 helps secure monitor module 1412 to cabinet body 1402. In one embodiment, one or more support structures 1416 may be comprised of rigid or semi-rigid material. In one example, support structure 1416 may be comprised of metal, plastic, wood, rubber, carbon fiber, and/or any combination thereof.

In a further embodiment, various components may be secured by adhesive. For example, glass 1410 may be secured to gasket 1406 by adhesive 1408. In another example, support structure 1416 may be secured to gasket 1406 by adhesive 1414. In still another example, gasket 1406 may be secured to cabinet body 1402 by adhesive 1404. One or more such adhesives (e.g., 1404, 1408, 1414) may be comprised of epoxies, polyurethanes, polyimides, paste, liquid, film, pellets, tape, hot melt, reactive hot melt, thermosetting, pressure sensitive, contact, structural, semi-structural, non-structural, and/or any combination of one or more thereof. In another embodiment, support structure 1416 may, in addition to or in place of adhesive, be secured to cabinet body 1402 by a mechanical device, such as a nail, screw, rivet, and/or other such mechanical attachment device.

Figure 15:
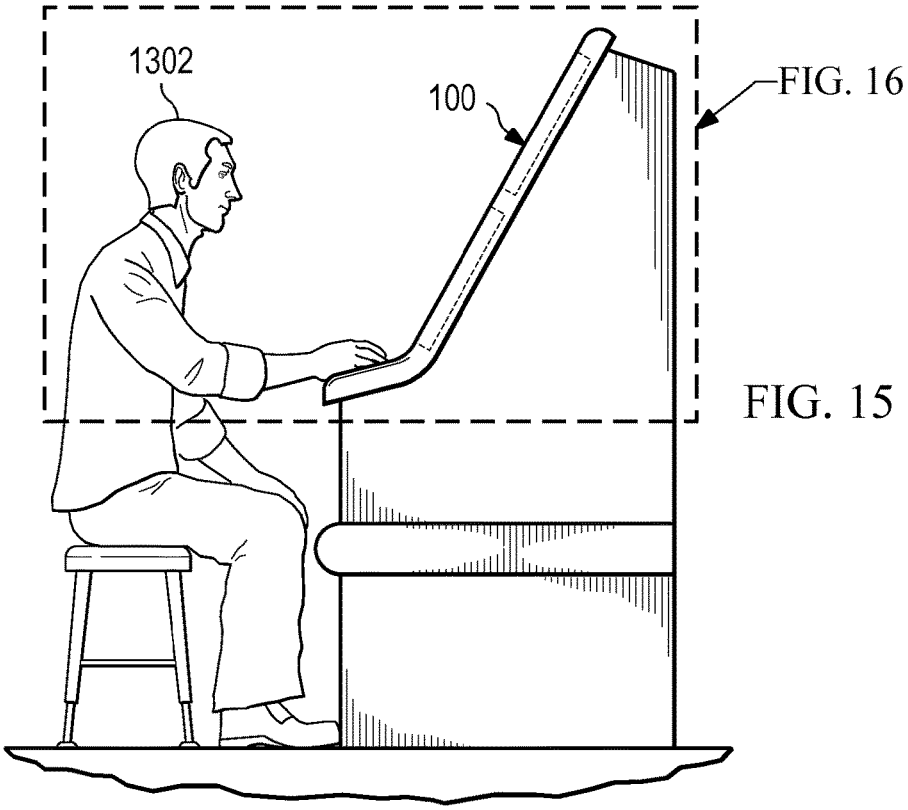
FIG. 15 is an illustration of the gaming system including adjacent flush mounted displays.
Figure 16:
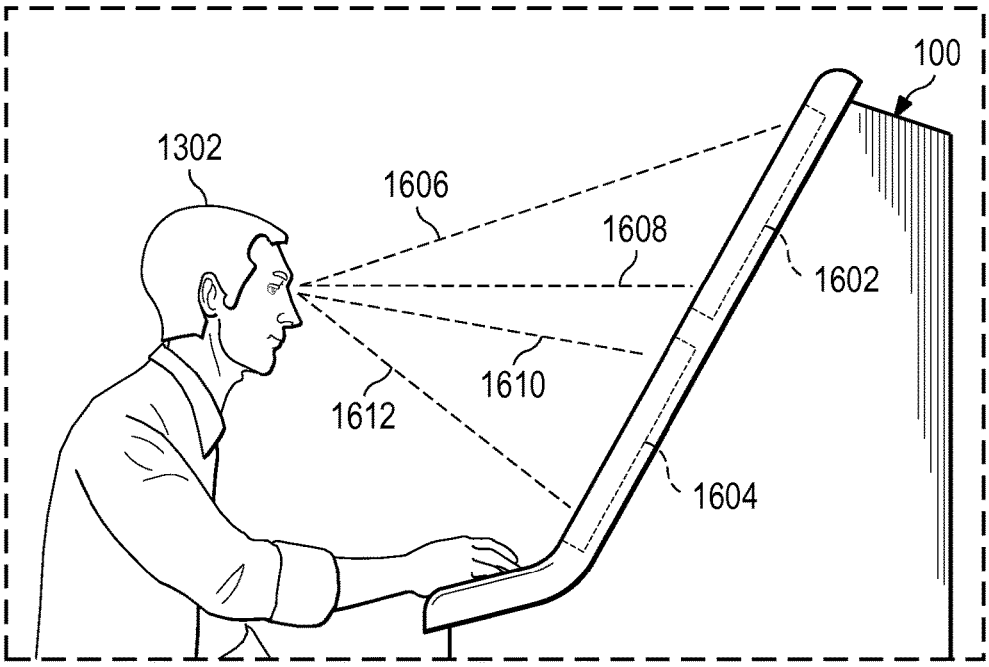
FIG. 16 is another illustration of the gaming system including adjacent flush mounted displays.

FIGS. 15 and 16 illustrate a gaming system including adjacent flush mounted displays. Specifically, electronic gaming system 100 may include a first monitor module 1604 and a second monitor module 1602 in a generally planar arrangement. In one embodiment, it is contemplated that a seated player 1302 may have a first FOV, generally delineated by lines 1610 and 1612, of the first monitor module 1604. In another embodiment, it is contemplated that a seated player 1302 may have a second FOV, generally delineated by lines 1606 and 1608, of the second monitor module 1602. As is apparent from FIG. 16, lines 1610 and 1612 are relatively equal in length, in comparison to lines 1606 and 1608, wherein top line 1606 is illustrated as being longer than bottom line 1608. FIG. 16 helps illustrate an example of where monitor modules (e.g. 1604 and 1602) are placed in a planar manner, it may create different viewing angles from a single player (e.g. 1302). It is contemplated that certain monitor modules may have optimum viewing angles than other monitor modules.

It is further contemplated that in some embodiments, in a configuration such as illustrated in FIG. 16, it may be preferable to install two different monitor module configurations in such a planar fashion, in order to provide a first monitor module 1604 with an optimum viewing angle occurring where the two lines of the expected FOV are relatively equidistant, and a second monitor module 1602 with an optimum viewing angle occurring where the top line 1606 of the expected FOV is longer than the bottom line 1608 of the FOV. It is also contemplated that in some embodiments, in a configuration as illustrated in FIG. 13, it may be preferable to install the same or similar monitor module configurations in a nonplanar fashion, as expected FOV's have associated equidistant lines (e.g., 1314 to 1316, and 1306 to 1308) and/or have associated lines that do not have one significantly longer than another (e.g. 1310 to 1312). In such a configuration, it is contemplated that manufacturing and/or associated supply costs may be minimized as a single monitor module configuration may be utilized for either of the monitor modules associated with an electronic gaming system 100.

Figure 17:
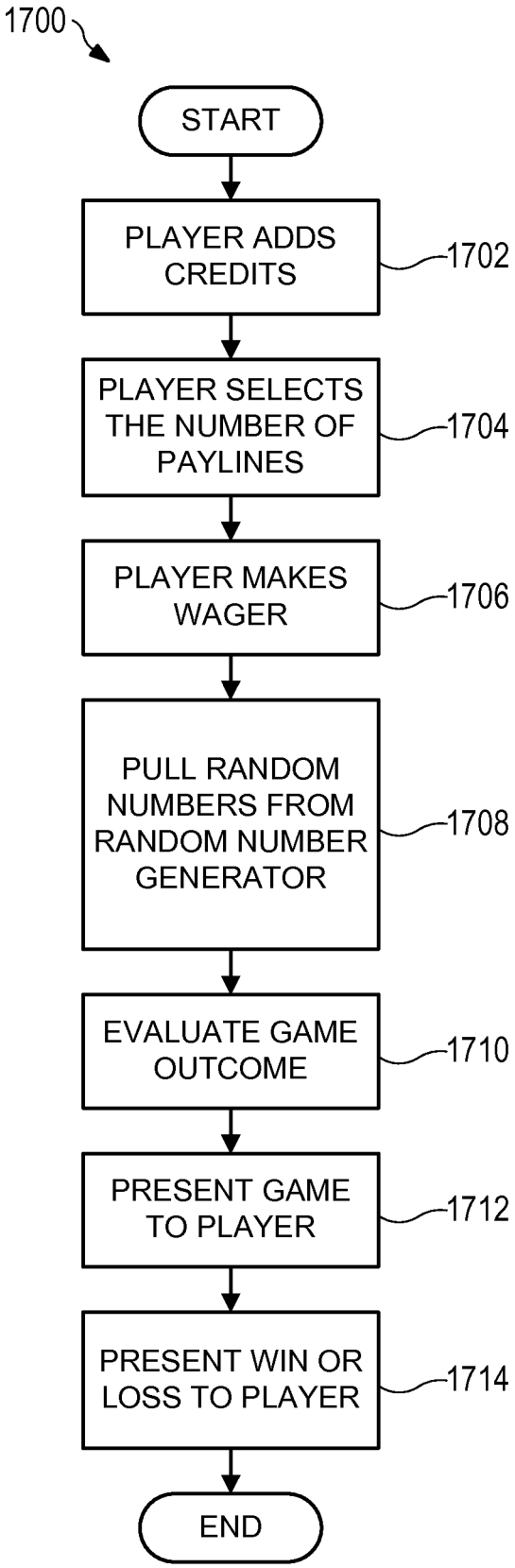
FIG. 17 is a flow diagram for game play, according to one embodiment.

FIG. 17 is a process flowchart of one example of a primary game play 1700 on an electronic gaming system, according to one embodiment. The method may include the step of a player adding credit to the electronic gaming system (step 1702). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1704, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1706, the player makes a wager on the game. In one embodiment, the wager may be a multiple of the number of paylines selected at step 1704. In another embodiment, the wager may not be a multiple of the number of paylines selected at step 1704. In a further embodiment, the wager may include a side-wager (e.g., ante bet), which may, in one example of such an embodiment, be used to make the player eligible to be awarded the extra functionality discussed above. It should be appreciated that in some embodiments, the order of steps 1704 and 1706 may be not critical, and so for example, a player can select the wager they wish to place, and then select the number of paylines they want it applied to, and that these embodiments are expressly contemplated as being within the scope of the present disclosure.

Continuing to step 1708, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 1710 and 1712, the gaming system utilizes the random numbers pulled at step 1708 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1714, the win or loss outcome may be identified for the player. In one embodiment, this step can include additional messaging, which provides information related to the win or loss, such as why the player won or lost. In another embodiment, this step can include identification of the amount of any award earned by the player.

Figure 18:
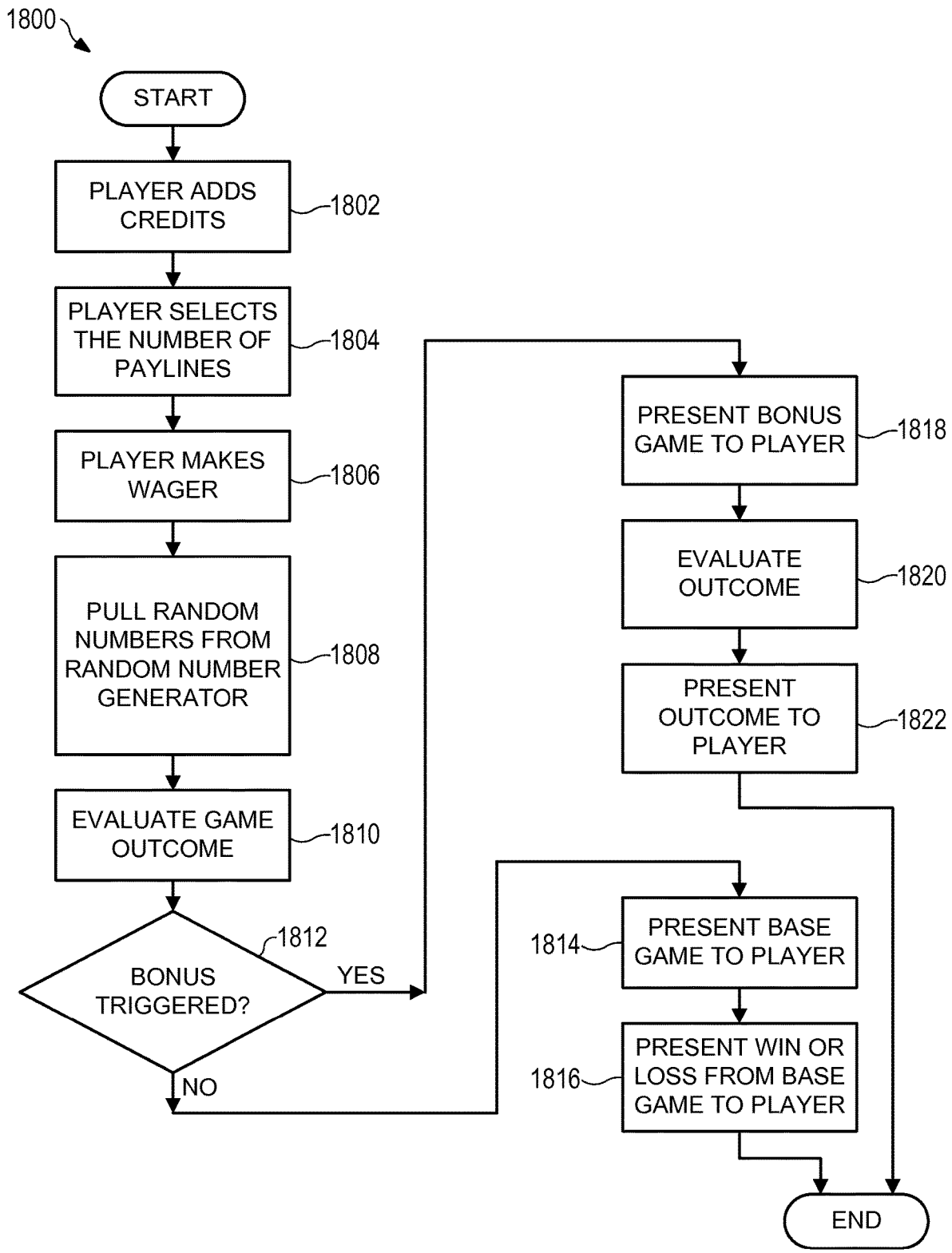
FIG. 18 is another flow diagram for game play, according to one embodiment.

FIG. 18 is a process flowchart of one example of a combined primary and secondary game play 1800 on an electronic gaming system, according to one embodiment. The method may include the step of a player adding credit to the electronic gaming system (step 1802). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1804, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1806, the player makes a wager on the game. In one embodiment, the wager may be a multiple of the number of paylines selected at step 1804. In another embodiment, the wager may not be a multiple of the number of paylines selected at step 1804. In a further embodiment, the wager may include a side-wager, which may, in one example of such an embodiment, be used to make the player eligible to be awarded the extra functionality discussed above. It should be appreciated that in some embodiments, the order of steps 1804 and 1806 may be not critical, and so for example, a player can select the wager they wish to place, and then select the number of paylines they want it applied to, and that these embodiments may be expressly contemplated as being within the scope of the present disclosure.

Continuing to step 1808, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 1810, the gaming system utilizes the random numbers pulled at step 1808 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1812, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the $2^{nd}$, $3^{rd}$ and $4^{th}$ reel. In another example, the bonus game may be triggered if matching symbols are displayed on the $1^{st}$, $2^{nd}$ and $3^{rd}$ reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 1814, where the base game may be fully presented to the player. As discussed above, the orders of step 1810, 1812, and 1814 can be changed without affecting the novel concepts disclosed herein.

At step 1816, the win or loss outcome of the primary game may be identified for the player. In one embodiment, this step can include additional messaging, which provides information related to the win or loss, such as why the player won or lost. In another embodiment, this step can include identification of the amount of any award earned by the player.

If it is determined at step 1812 that a bonus or secondary game was triggered, then process 1800 continues to step 1818, where the secondary game may be presented to the player. As discussed above, there are numerous ways to present the secondary or bonus game to the player.

At steps 1820 and 1822, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 1800 ending after step 1822, the process continues to step 1814 so as to finalize the primary game outcome presentation to the player.

Figure 19:
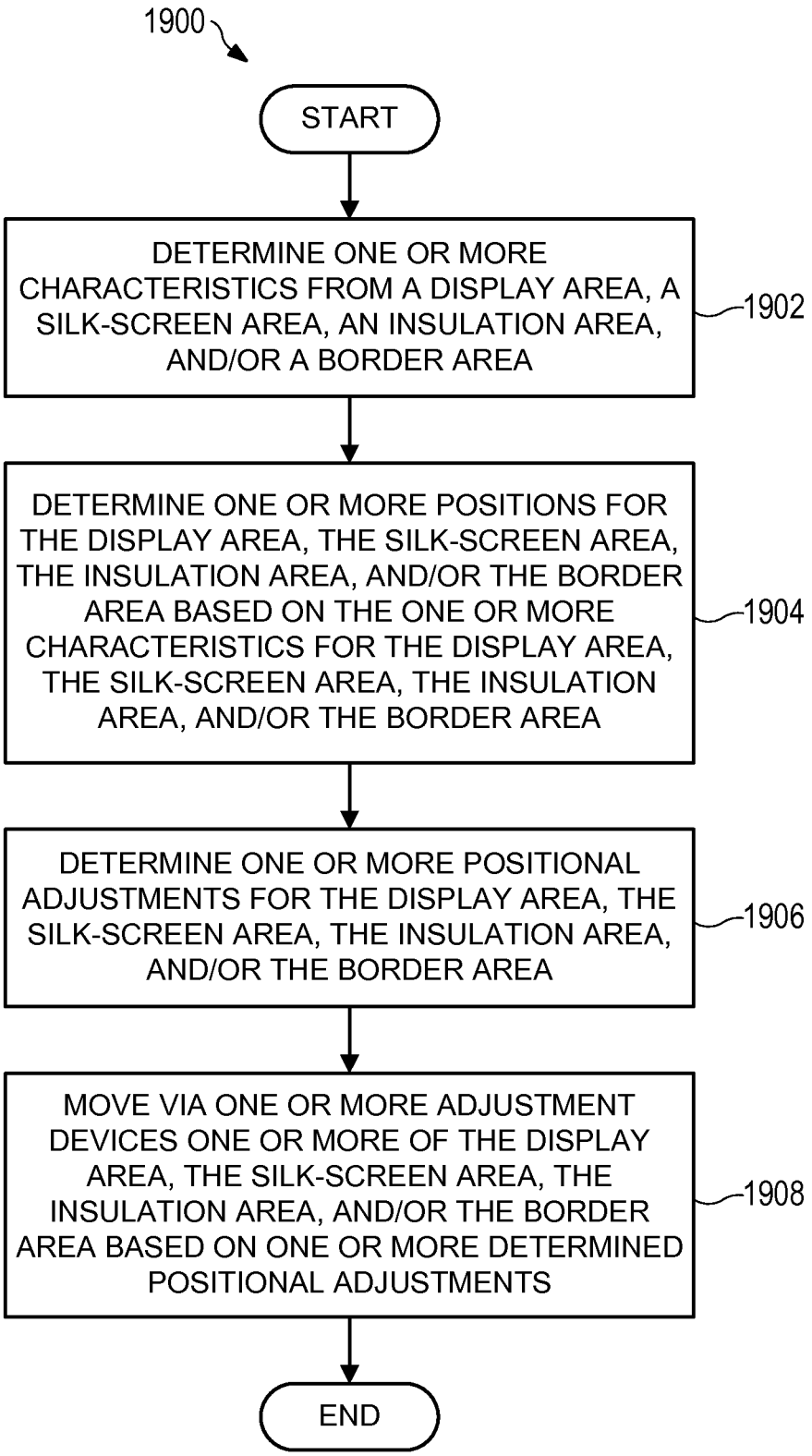
FIG. 19 is a flow diagram to reposition device areas, according to one embodiment.

In FIG. 19, a flow diagram to reposition device areas is shown, according to one embodiment. The method may include determining one or more characteristics from a first display area, a silk-screen area, an insulation area, and/or a border area (step 1902). The method may include determining one or more positions for the first display area, the silk-screen area, the insulation area, and the border area based on the one or more characteristics for the first display area, the silk-screen area, the insulation area, and/or the border area (step 1904). The method may include determining one or more positional adjustments for the first display area, the silk-screen area, the insulation area, and/or the border area (step 1906). The method may include moving via one or more adjustment devices one or more of the first display area, the silk-screen area, the insulation area, and/or the border area based on one or more determined positional adjustments (step 1908).

Figure 20:
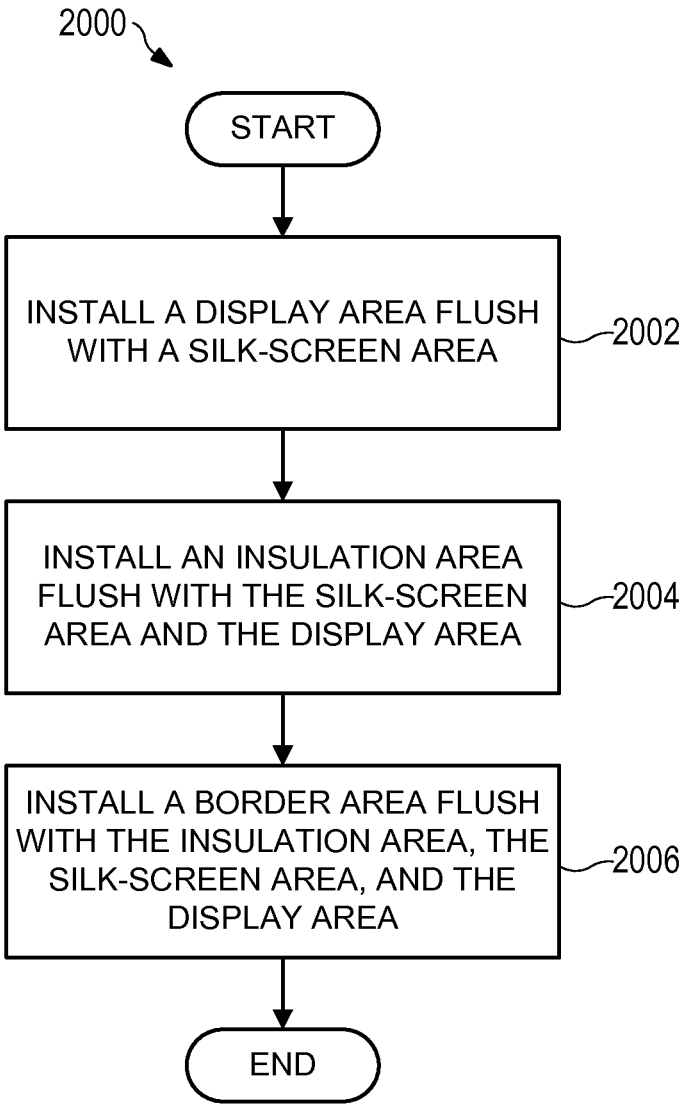
FIG. 20 is assembly flow diagram for the gaming device, according to one embodiment.

In FIG. 20, an assembly flow diagram for the gaming device is shown, according to one embodiment. The method may include installing a display area flush with a silk-screen area (step 2002). The method may include installing an insulation area flush with the silk-screen area and/or the display area (step 2004). The method may include installing a border area flush with the insulation area, the silk-screen area, and/or the display area (step 2006).

In one embodiment, the electronic gaming system may include a first display device. The first display device may include a first display area, a first silk-screen area, a first insulation area, and a first border area. The first display area, the first silk-screen area, the first insulation area, and the first border area may be flush with each other. The first display area, the first silk-screen area, the first insulation area, and the first border area may have surfaces that are in the same plane and/or even with each other. For example, when a player moves his and/or her hand over these surfaces the player would not be able to tell when one surface started and stopped. The first insulation area may provide electrical isolation and/or mechanical buffering between the border area, the first display area, the first silk-screen area, and/or any other areas. The electronic gaming system may include one or more memory devices and one or more processors. The one or more processors may be configured to receive a plurality of instructions from the one or more memory devices, which when executed by the one or more processors, cause the one or more processors to operate with the first display device, for a play of a game, to; determine a wager placed by a player of the electronic gaming system; cause the first display device to display a game play; determine an outcome for the game play; and/or cause the gaming system to provide any awards based at least in part on the determined outcome of the game play.

In another example, the electronic gaming system may include a second display device. The second display device may include a second display area, a second silk-screen area, a second insulation area, and a second border area. The second display area, the second silk-screen area, the second insulation area, and/or the second border area may be flush with each other. The second insulation area may provide electrical isolation between the second border area and at least one of the second area and the second silk-screen area. The second insulation area may provide a mechanical buffer between the second border area and at least one of the second display area and the second silkscreen area.

In another example, the electronic gaming system may further include a seal area located between the first display device and the second display device. The seal area may provide shock absorption between the first display device, the second display device, and/or any other devices.

The first display device, the second display device, and/or any display device may be a touchscreen display device. The silk-screen area may include one or more display advertisements.

In another example, the electronic gaming system may include one or more cameras, one or more sensing devices, and/or one or more motion detection devices.

In another example, the one or more cameras, the one or more sensing devices, and/or the one or more motion detection devices may be utilized to receive one or more inputs. In another example, the electronic gaming system may include one or more adjustment devices. The one or more adjustment devices may reposition one or more of the first display area, the silkscreen area, the insulation area, and/or the border area.

In another example, the one or more adjustment devices may reposition the first display area, the silk-screen area, the insulation area, and/or the border area based on a player's input and/or one or more characteristics from the first display area, the silk-screen area, the insulation area, and/or the border area.

In another embodiment, a method of game play via an electronic gaming system may include: determining one or more characteristics from a first display area, a silk-screen area, an insulation area, and/or a border area; determining one or more positions for the first display area, the silk-screen area, the insulation area, and/or the border area based on the one or more characteristics for the first display area, the silk-screen area, the insulation area, and/or the border area; determining one or more positional adjustments for the first display area, the silk-screen area, the insulation area, and/or the border area; and/or moving via one or more adjustment devices one or more of the first display area, the silk-screen area, the insulation area, and/or the border area based one or more determined positional adjustments.

In another example, the one or more positional adjustments may be at least in part based on player input. In another example, the one or more positional adjustments may be at least in part based on performance data (e.g., lumens, output characteristics, etc.) from the first display device.

In another example, the one or more positional adjustments may be are at least in part based on a device procedure. In another example, the device procedure may be a maintenance procedure (e.g., cleaning, recalibrating, etc.).

In another embodiment, the electronic gaming system may include a first display device. The first display device may include a first display area, a first silk-screen area, a first insulation area, and/or a first border area. The first display area; the first silk-screen area; the first insulation area; and/or the first border area may be flush with each other. The first insulation area may provide electrical isolation between the first border area, the first display area, the first silk-screen area, and/or any other areas. The insulation area may provide a mechanical buffer between the border area, the first display area, the first silkscreen area, and/or any other areas. The electronic gaming system may include a second display device. The second display device may include a second display area, a second silk-screen area, a second insulation area, and a second border area. The second display area, the second silk-screen area, the second insulation area, and/or the second border area may be flush with each other. The second insulation area may provide electrical isolation between the second border area, the second area, the second silk-screen area, and/or any other areas. The second insulation area may provide a mechanical buffer between the second border area, the second area, the second silk-screen area, and/or any other areas.

The electronic gaming system may include a seal area located between the first display device and the second display device. The seal area may be at least one of a mechanical buffer and/or an electrical isolator between the first display device and the second display device. The electronic gaming system may include one or more memory devices. The electronic gaming system may include one or more depth image sensing devices. The electronic gaming system may include one or more processors which may be configured to receive a plurality of instructions from the one or more memory devices, which when executed by the one or more processors, cause the one or more processors to operate with the first display device, for a play of a game, to: determine a wager placed by a player of the electronic gaming system; cause the first display device to display a game play; detect a first body part of a first player; detect a second body part of a second player; identify the detected first and second body parts; detect a first 3D movement of the detected first body part; detect a second 3D movement of the detected second body part; correlate the detected first 3D movement and the identified first body part to a first one of a plurality of reference models; correlate the detected second 3D movement and the identified second body part to a different second one of the plurality of reference models; determine a first player input based on the correlated first reference model; determine a second player input based on the correlated second reference model; determine a game input based on the first player input and the second player input; determine an outcome for the game play; and/or cause the gaming system to provide any awards based at least in part on the determined outcome of the game play.

In another example, the electronic gaming system may further include one or more adjustment devices. The one or more adjustment devices may reposition one or more of the first display area, the silk-screen area, the insulation area, and/or the border area.

In another example, the one or more adjustment devices may reposition the first display area, the silk-screen area, the insulation area, and/or the border area based on at least one of a player's input and one or more characteristics from the first display area, the silk-screen area, the insulation area, and the border area.

In another example, the one or more depth image sensing devices may via the one or more processors generate one or more scenes. In another example, the one or more scenes may be utilized to modify one or more display presentations on at least one of the first display device and the second display device.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system may be powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system may be different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. An electronic gaming device comprising:

a housing;

a display frame connected to said housing, said display frame having a display opening;

a first electronic video display mounted to said housing and located in said display opening of said display frame, said first electronic video display having a front screen having a peripheral edge which extends around a display area, a peripheral border extending over said front screen between said peripheral edge thereof and said display area, at least one insulating strip positioned between said first electronic video display and said display frame at said peripheral edge of said front screen;

a second electronic video display mounted to said housing and located in said display opening of said display frame, said first electronic video display having a bottom and said second electronic video display having a top, said bottom of said first electronic video display separated from said top of said electronic video display by a gap, and wherein said at least one insulating strip is located in said gap;

one or more memory devices; and one or more processors configured to receive a plurality of instructions from the one or more memory devices, which when executed by the one or more processors, cause the one or more processors to operate with at least one of the first and second electronic video displays, for a play of a game, to:

(a) determine a wager placed by a player of the electronic gaming device;

(b) cause the at least one of the first and second electronic video displays to display a game play;

(c) determine an outcome for the game play; and (d) cause the gaming system to provide any awards based at least in part on the determined outcome of the game play.

2. The electronic gaming device in accordance with claim 1 wherein said front screen comprises a glass in front of a display surface of a display device.

3. The electronic gaming device in accordance with claim 1 wherein said front screen comprises a front touch screen surface of said first electronic video display.

4. The electronic gaming device in accordance with claim 1 wherein a front surface of said front screen, a front of said peripheral border, a front of said at least one insulating strip and a front of said display frame all lie in substantially the same plane.

5. The electronic gaming device in accordance with claim 1 wherein said at least one insulating strip comprises an electrically insulating material.

6. The electronic gaming device in accordance with claim 1 wherein said at least one insulating strip comprise a shock-absorbing material.

7. The electronic gaming device in accordance with claim 1 further comprising at least one support structure extending behind said first and second electronic video displays which mounts said first and second electronic video displays to said housing and maintains said first and second electronic video displays in said display frame.

8. The electronic gaming device in accordance with claim 1 wherein said at least one insulating strip has a color attribute designating a function of said strip, wherein different color attributes designate different functions.

9. The electronic gaming device in accordance with claim 8 wherein said at least one insulating strip is a first color when said insulating strip is configured primarily as an electrical insulator and is a second color when said insulating strip is configured primarily as a shock absorbing element.

10. The electronic gaming device in accordance with claim 1 wherein said at least one insulating strip seals a space between said first electronic video display and said display frame at said peripheral edge of said front screen.

11. A display assembly for an electronic gaming device comprising:

a display frame, said display frame having a display opening;

a first electronic video display located in said display opening of said display frame, said first electronic video display having a front screen having a peripheral edge which extends around a display area, a peripheral border extending over said front screen between said peripheral edge thereof and said display area, and at least one insulating strip positioned between said electronic video display and said display frame at said peripheral edge of said front screen; and a second electronic video display located in said display opening of said display frame, said first electronic video display having a bottom and said second electronic video display having a top, said bottom of said first electronic video display separated from said top of said electronic video display by a gap, and wherein said at least one insulating strip is located in said gap.

12. The display assembly in accordance with claim 11 wherein said display frame and said first and second electronic video displays are mounted to a housing of said electronic gaming device.

13. The display assembly in accordance with claim 12 further comprising at least one support structure extending behind said electronic video display for mounting said first and second electronic video displays to a housing of said electronic gaming device.

14. The display assembly in accordance with claim 11 wherein said front screen comprises a glass in front of a display surface of a display device.

15. The display assembly in accordance with claim 11 wherein said front screen comprises a front touch screen surface of said first electronic video display.

16. The display assembly in accordance with claim 11 wherein a front surface of said front screen, a front of said peripheral border, a front of said at least one insulating strip and a front of said display frame all lie in substantially the same plane.

17. The display assembly in accordance with claim 11 wherein said at least one insulating strip comprises an electrically insulating material.

18. The display assembly in accordance with claim 11 wherein said at least one insulating strip comprises a shock-absorbing material.

19. The display assembly in accordance with claim 11 wherein said at least one insulating strip has a color attribute designating a function of said strip, wherein different color attributes designate different functions.

20. The display assembly in accordance with claim 19 wherein said at least one insulating strip is a first color when said insulating strip is configured primarily as an electrical insulator and is a second color when said insulating strip is configured primarily as a shock absorbing element.

21. The display assembly in accordance with claim 11 wherein said at least one insulating strip seals a space between said first electronic video display and said display frame at said peripheral edge of said front screen.

22. A display assembly for an electronic gaming device comprising:

a display frame, said display frame having a display opening; and a first electronic video display located in said display opening of said display frame, said first electronic video display having a front screen having a peripheral edge which extends around a display area, a peripheral border extending over said front screen between said peripheral edge thereof and said display area, and at least one insulating strip positioned between said electronic video display and said display frame at said peripheral edge of said front screen;

wherein said at least one insulating strip has a color attribute designating a function of said strip, wherein different color attributes designate different functions.

23. The display assembly in accordance with claim 22 wherein said at least one insulating strip is a first color when said insulating strip is configured primarily as an electrical insulator and is a second color when said insulating strip is configured primarily as a shock absorbing element.

24. The display assembly in accordance with claim 22 wherein said display frame is connected to a housing of a gaming machine which further comprises:

one or more memory devices; and one or more processors configured to receive a plurality of instructions from the one or more memory devices, which when executed by the one or more processors, cause the one or more processors to operate with at least one of the first and second electronic video displays, for a play of a game, to:

(a) determine a wager placed by a player of the electronic gaming device;

(b) cause the at least one of the first and second electronic video displays to display a game play;

(c) determine an outcome for the game play; and (d) cause the gaming system to provide any awards based at least in part on the determined outcome of the game play.

* * * * *